US010144999B2

(12) United States Patent
Bryan

(10) Patent No.: US 10,144,999 B2
(45) **Date of Patent: *Dec. 4, 2018**

(54) PROCESSING OF ALPHA/BETA TITANIUM ALLOYS

(71) Applicant: ATI Properties LLC, Albany, OR (US)

(72) Inventor: David J. Bryan, Indian Trail, NC (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/653,985

(22) Filed: Jul. 19, 2017

(65) Prior Publication Data

US 2018/0016670 A1 Jan. 18, 2018

Related U.S. Application Data

(63) Continuation of application No. 15/005,281, filed on Jan. 25, 2016, now Pat. No. 9,765,420, which is a continuation of application No. 12/838,674, filed on Jul. 19, 2010, now Pat. No. 9,255,316.

(51) Int. Cl.

| | |
|---|---|
| ***C22F 1/18*** | (2006.01) |
| ***C22C 14/00*** | (2006.01) |
| ***C21D 1/26*** | (2006.01) |

(52) U.S. Cl.

CPC ..... *C22F 1/183* (2013.01); *C21D 1/26* (2013.01); *C22C 14/00* (2013.01); *C22F 1/18* (2013.01)

(58) Field of Classification Search

CPC ..... C22F 1/183; C22F 1/18; C22C 14/00

See application file for complete search history.

(56) References Cited

U.S. PATENT DOCUMENTS

| | | | |
|---|---|---|---|
| 2,857,269 | A | 10/1958 | Vordahl |
| 2,893,864 | A | 7/1959 | Harris et al. |
| 2,974,076 | A | 7/1959 | Vordahl |
| 2,932,886 | A | 4/1960 | Althouse |
| 3,015,292 | A | 1/1962 | Bridwell |
| 3,025,905 | A | 3/1962 | Haerr |
| 3,060,564 | A | 10/1962 | Corral |
| 3,082,083 | A | 3/1963 | Levy et al. |
| 3,117,471 | A | 1/1964 | O'Connell et al. |

(Continued)

FOREIGN PATENT DOCUMENTS

| | | | |
|---|---|---|---|
| CA | 2787980 | A | 7/2011 |
| CN | 1070230 | A | 3/1993 |

(Continued)

OTHER PUBLICATIONS

"Allvac TiOsteum and TiOstalloy Beat Titanium Alloys", printed from www.allvac.com/allvac/pages/Titanium/TiOsteum.htm on Nov. 7, 2005.

(Continued)

*Primary Examiner* — Matthew E. Hoban

(74) *Attorney, Agent, or Firm* — K&L Gates LLP

(57) ABSTRACT

Processes for forming an article from an α+β titanium alloy are disclosed. The α+β titanium alloy includes, in weight percentages, from 2.90 to 5.00 aluminum, from 2.00 to 3.00 vanadium, from 0.40 to 2.00 iron, and from 0.10 to 0.30 oxygen. The α+β titanium alloy is cold worked at a temperature in the range of ambient temperature to 500° F., and then aged at a temperature in the range of 700° F. to 1200° F.

21 Claims, 12 Drawing Sheets

(56) References Cited

U.S. PATENT DOCUMENTS 3,313,138 A 4/1967 Spring et al.
3,379,522 A 4/1968 Vordahl
3,436,277 A 4/1969 Bomberger, Jr. et al.
3,469,975 A 9/1969 Bomberger, Jr. et al.
3,489,617 A 1/1970 Wuerfel
3,584,487 A 6/1971 Carlson
3,605,477 A 9/1971 Carlson
3,615,378 A 10/1971 Bomberger, Jr. et al.
3,635,068 A 1/1972 Watmough et al.
3,649,259 A 3/1972 Heitman
3,676,225 A 7/1972 Owczarski et al.
3,686,041 A 8/1972 Lee
3,802,877 A 4/1974 Parris et al.
3,815,395 A 6/1974 Sass
3,835,282 A 9/1974 Sass et al.
3,922,899 A 12/1975 Fremont et al.
3,979,815 A 9/1976 Nakanose et al.
4,053,330 A 10/1977 Henricks et al.
4,067,734 A 1/1978 Curtis et al.
4,094,708 A 6/1978 Hubbard et al.
4,098,623 A 7/1978 Ibaraki et al.
4,120,187 A 10/1978 Mullen
4,138,141 A 2/1979 Andersen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,309,226 A 1/1982 Chen
4,472,207 A 9/1984 Kinoshita et al.
4,473,125 A 9/1984 Addudle et al.
4,482,398 A 11/1984 Eylon et al.
4,510,788 A 4/1985 Ferguson et al.
4,543,132 A 9/1985 Berczik et al.
4,614,550 A 9/1986 Leonard et al.
4,631,092 A 12/1986 Ruckle et al.
4,639,231 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,798,632 A 1/1989 Yonezawa et al.
4,799,975 A 1/1989 Ouchi et al.
4,808,249 A 2/1989 Eyelon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,330,591 A 7/1994 Vasseur
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship et al.
5,558,728 A 9/1996 Kobayashi et al.
5,530,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,954,724 A 9/1999 Davidson
5,930,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hataligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,234,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,576,068 B2 6/2003 Grubb et al.
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.

(56) References Cited

U.S. PATENT DOCUMENTS

| | | | |
|---|---|---|---|
| 6,786,985 | B2 | 9/2004 | Kosaka et al. |
| 6,800,153 | B2 | 10/2004 | Ishii et al. |
| 6,823,705 | B2 | 11/2004 | Fukuda et al. |
| 6,908,517 | B2 | 6/2005 | Segal et al. |
| 6,918,971 | B2 | 7/2005 | Fujii et al. |
| 6,932,877 | B2 | 8/2005 | Raymond et al. |
| 6,971,256 | B2 | 12/2005 | Okada et al. |
| 7,008,491 | B2 | 3/2006 | Woodfield |
| 7,010,950 | B2 | 3/2006 | Cai et al. |
| 7,032,426 | B2 | 4/2006 | Durney et al. |
| 7,037,389 | B2 | 5/2006 | Barbier et al. |
| 7,038,426 | B2 | 5/2006 | Hill |
| 7,031,173 | B2 | 7/2006 | Bahar et al. |
| 7,096,596 | B2 | 8/2006 | Hernandez, Jr. et al. |
| 7,132,021 | B2 | 11/2006 | Kuroda et al. |
| 7,152,449 | B2 | 12/2006 | Durney et al. |
| 7,264,682 | B2 | 9/2007 | Chandran et al. |
| 7,269,986 | B2 | 9/2007 | Pfaffmann et al. |
| 7,332,043 | B2 | 2/2008 | Tetyukhln et al. |
| 7,410,610 | B2 | 8/2008 | Woodfield et al. |
| 7,438,849 | B2 | 10/2008 | Kuramoto et al. |
| 7,449,075 | B2 | 11/2008 | Woodfield et al. |
| 7,536,892 | B2 | 5/2009 | Amino et al. |
| 7,559,221 | B2 | 7/2009 | Horita et al. |
| 7,601,232 | B2 | 10/2009 | Fonte |
| 7,611,592 | B2 | 11/2009 | Davis et al. |
| 7,708,841 | B2 | 5/2010 | Saller et al. |
| 7,837,812 | B2 | 11/2010 | Marquardt et al. |
| 7,879,286 | B2 | 2/2011 | Miracle et al. |
| 7,947,136 | B2 | 5/2011 | Saller |
| 7,984,635 | B2 | 7/2011 | Callebaut et al. |
| 8,037,730 | B2 | 10/2011 | Polen et al. |
| 8,043,446 | B2 | 10/2011 | Jung et al. |
| 8,048,240 | B2 | 11/2011 | Hebda et al. |
| 8,128,764 | B2 | 3/2012 | Miracle et al. |
| 8,211,548 | B2 | 7/2012 | Chun et al. |
| 8,316,687 | B2 | 11/2012 | Slattery |
| 8,336,359 | B2 | 12/2012 | Werz |
| 8,408,039 | B2 | 4/2013 | Cao et al. |
| 8,430,075 | B2 | 4/2013 | Qiao et al. |
| 8,454,765 | B2 | 6/2013 | Saller et al. |
| 8,499,605 | B2 | 8/2013 | Bryan |
| 8,551,264 | B2 | 10/2013 | Kosaka et al. |
| 8,568,540 | B2 | 10/2013 | Marquardt et al. |
| 8,578,748 | B2 | 11/2013 | Huskamp et al. |
| 8,597,442 | B2 | 12/2013 | Hebda et al. |
| 8,597,443 | B2 | 12/2013 | Hebda et al. |
| 8,608,913 | B2 | 12/2013 | Shim et al. |
| 8,613,818 | B2 | 12/2013 | Forbes Jones et al. |
| 8,623,155 | B2 | 1/2014 | Marquardt et al. |
| 8,652,400 | B2 | 2/2014 | Forbes Jones et al. |
| 8,679,269 | B2 | 3/2014 | Goller et al. |
| 8,834,653 | B2 | 9/2014 | Bryan |
| 8,919,168 | B2 | 12/2014 | Valiev et al. |
| 9,034,247 | B2 | 5/2015 | Suzuki et al. |
| 9,050,647 | B2 | 6/2015 | Thomas et al. |
| 9,192,981 | B2 | 11/2015 | Forbes Jones et al. |
| 9,206,497 | B2 | 12/2015 | Bryan et al. |
| 9,255,316 | B2 | 2/2016 | Bryan |
| 9,523,137 | B2 | 12/2016 | Marquardt et al. |
| 9,616,480 | B2 | 4/2017 | Forbes Jones et al. |
| 9,624,567 | B2 | 4/2017 | Bryan et al. |
| 9,732,408 | B2 | 8/2017 | Sanz et al. |
| 9,765,420 | B2 | 9/2017 | Bryan |
| 9,777,361 | B2 | 10/2017 | Thomas et al. |
| 9,796,005 | B2 | 10/2017 | Hebda et al. |
| 2002/0033717 | A1 | 3/2002 | Matsuo |
| 2003/0168138 | A1 | 9/2003 | Marquardt |
| 2004/0099350 | A1 | 5/2004 | Manitone et al. |
| 2004/0148997 | A1 | 8/2004 | Amino et al. |
| 2004/0221929 | A1 | 11/2004 | Hebda et al. |
| 2004/0250932 | A1 | 12/2004 | Briggs |
| 2005/0047952 | A1 | 3/2005 | Coleman |
| 2005/0145310 | A1 | 7/2005 | Bewlay et al. |
| 2006/0045789 | A1 | 3/2006 | Nasserrafi et al. |
| 2006/0110614 | A1 | 5/2006 | Liimatainen |
| 2006/0243356 | A1 | 11/2006 | Oikawa et al. |
| 2007/0017273 | A1 | 1/2007 | Haug et al. |
| 2007/0098588 | A1 | 5/2007 | Narita et al. |
| 2007/0193662 | A1 | 8/2007 | Jablokov et al. |
| 2008/0000554 | A1 | 1/2008 | Yaguchi et al. |
| 2008/0103543 | A1 | 5/2008 | Li et al. |
| 2008/0107559 | A1 | 5/2008 | Nishiyama et al. |
| 2008/0202189 | A1 | 8/2008 | Otaki |
| 2008/0210345 | A1 | 9/2008 | Tetyukhin et al. |
| 2008/0264932 | A1 | 10/2008 | Hirota |
| 2009/0000706 | A1 | 1/2009 | Huron et al. |
| 2009/0183804 | A1 | 7/2009 | Zhao et al. |
| 2009/0234385 | A1 | 9/2009 | Cichocki et al. |
| 2011/0180188 | A1 | 7/2011 | Bryan et al. |
| 2012/0067100 | A1 | 3/2012 | Stefansson et al. |
| 2012/0076611 | A1 | 3/2012 | Bryan |
| 2012/0076612 | A1 | 3/2012 | Bryan |
| 2012/0076686 | A1 | 3/2012 | Bryan |
| 2012/0279351 | A1 | 11/2012 | Gu et al. |
| 2013/0062003 | A1 | 3/2013 | Shulkin et al. |
| 2013/0156628 | A1 | 6/2013 | Forbes Jones et al. |
| 2014/0076471 | A1 | 3/2014 | Forbes Jones et al. |
| 2014/0238552 | A1 | 8/2014 | Forbes Jones et al. |
| 2014/0261922 | A1 | 9/2014 | Thomas et al. |
| 2015/0129093 | A1 | 5/2015 | Forbes Jones et al. |
| 2016/0122851 | A1 | 5/2016 | Jones et al. |
| 2016/0201165 | A1 | 7/2016 | Foltz, IV |
| 2017/0058387 | A1 | 3/2017 | Marquardt et al. |
| 2017/0146046 | A1 | 5/2017 | Foltz, IV |
| 2017/0218485 | A1 | 8/2017 | Jones et al. |
| 2017/0321313 | A1 | 11/2017 | Thomas et al. |
| 2017/0349977 | A1 | 12/2017 | Forbes Jones et al. |
| 2018/0073092 | A1 | 3/2018 | Forbes Jones et al. |

FOREIGN PATENT DOCUMENTS

| | | | |
|---|---|---|---|
| CN | 1194671 | A | 9/1998 |
| CN | 1403622 | | 3/2003 |
| CN | 1816641 | A | 8/2006 |
| CN | 101104898 | A | 1/2008 |
| CN | 101205593 | A | 6/2008 |
| CN | 101294264 | A | 10/2008 |
| CN | 101684530 | A | 3/2010 |
| CN | 101637789 | B | 6/2011 |
| CN | 102212716 | A | 10/2011 |
| CN | 102816953 | A | 12/2012 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1433863 | | 6/2004 |
| EP | 1471158 | A1 | 10/2004 |
| EP | 1605073 | A1 | 12/2005 |
| EP | 1612289 | A2 | 1/2006 |
| EP | 1375690 | B1 | 3/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| FR | 2545104 | A1 | 11/1984 |
| GB | 847.103 | | 9/1960 |
| GB | 1170997 | A | 11/1969 |
| GB | 1433306 | | 4/1976 |
| GB | 2151260 | A | 7/1985 |

(56) References Cited

FOREIGN PATENT DOCUMENTS

| | | | |
|---|---|---|---|
| GB | 2337762 | A | 12/1999 |
| JP | 55-113865 | A | 9/1980 |
| JP | 57-62820 | A | 4/1982 |
| JP | 57-62846 | A | 4/1982 |
| JP | S58-210158 | A | 12/1983 |
| JP | 60-046358 | | 3/1985 |
| JP | 60-100655 | A | 6/1985 |
| JP | S61-060871 | | 3/1986 |
| JP | S61-217564 | A | 9/1986 |
| JP | 62-109956 | A | 5/1987 |
| JP | 62-127074 | A | 6/1987 |
| JP | 62-149859 | A | 7/1987 |
| JP | S62-227597 | A | 10/1987 |
| JP | S63-49302 | A | 3/1988 |
| JP | S63-188426 | A | 8/1988 |
| JP | H01-272750 | A | 10/1989 |
| JP | 1-279736 | A | 11/1989 |
| JP | 2-205661 | A | 8/1990 |
| JP | 3-134124 | A | 6/1991 |
| JP | H03-138343 | A | 6/1991 |
| JP | H03-166350 | A | 7/1991 |
| JP | H03-264618 | A | 11/1991 |
| JP | 4-74856 | A | 3/1992 |
| JP | 4-103737 | A | 4/1992 |
| JP | 4-143236 | A | 5/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | 9-194969 | A | 11/1993 |
| JP | H05-293555 | A | 11/1993 |
| JP | 8-300044 | A | 11/1996 |
| JP | 9-143650 | | 6/1997 |
| JP | 9-215786 | A | 8/1997 |
| JP | H10-128459 | A | 5/1998 |
| JP | H10-306335 | A | 11/1998 |
| JP | H11-21642 | A | 1/1999 |
| JP | H11-309521 | A | 11/1999 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-69591 | A | 3/2002 |
| JP | 2002-146497 | A | 5/2002 |
| JP | 2003-55749 | A | 2/2003 |
| JP | 2003-74566 | A | 3/2003 |
| JP | 2003-285126 | A | 10/2003 |
| JP | 2003-334633 | A | 11/2003 |
| JP | 2004-131761 | | 4/2004 |
| JP | 2005-281855 | A | 10/2005 |
| JP | 2007-291488 | A | 11/2007 |
| JP | 2007-327118 | A | 12/2007 |
| JP | 2008-200730 | A | 9/2008 |
| JP | 2009-138218 | A | 6/2009 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| JP | 2015-54332 | A | 3/2015 |
| KR | 920004946 | | 6/1992 |
| KR | 10-2005-0087765 | A | 8/2005 |
| KR | 10-2009-0069647 | A | 7/2009 |
| RU | 2003417 | C1 | 11/1993 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2217260 | C1 | 11/2003 |
| RU | 2234998 | C1 | 8/2004 |
| RU | 2269584 | C1 | 2/2006 |
| RU | 2288967 | C1 | 12/2006 |
| RU | 2364660 | C1 | 8/2009 |
| RU | 2368695 | C1 | 9/2009 |
| RU | 2378410 | C1 | 1/2010 |
| RU | 2392348 | C2 | 6/2010 |
| RU | 2393936 | C1 | 7/2010 |
| RU | 2441089 | C1 | 1/2012 |
| SU | 534518 | A1 | 1/1977 |
| SU | 631234 | A | 11/1978 |
| SU | 1077328 | A | 5/1982 |
| SU | 1135798 | A1 | 1/1985 |
| SU | 1088397 | A1 | 2/1991 |
| UA | 38805 | A | 5/2001 |
| UA | 40862 | A | 8/2001 |
| UA | A200613448 | | 6/2008 |
| WO | WO 98/17836 | A1 | 4/1998 |
| WO | WO 98/22629 | A | 5/1998 |
| WO | WO 02/086172 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2007/142379 | A1 | 12/2007 |
| WO | WO 2008/017257 | A1 | 2/2008 |
| WO | WO 2009/082498 | A1 | 7/2009 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

"Datasheet: Timetal 21S", Alloy Digest, Advanced Materials and Processes (Sep. 98), pp. 38-39.

"Heat Treating of Nonferrous Alloys: Heat Treating of Titanium and Titanium Alloys," Metals Handbook, ASM Handbooks Online (2002).

"Stryker Orthopaedics TMZF® Alloy (UNS R58120)", printed from www.allvac.com/allvac/pages/Titanium/UNSR58120.htm on Nov. 7, 2005.

"Technical Data Sheet: Allvac® Ti-15Mo Beta Titanium Alloy" (dated Jun. 16, 2004).

ASM Materials Engineering Dictionary, "Blasting or Blast Cleaning." J.R. Davis Ed., ASM International, Materials Park, OH (1992) p. 42.

"ASTM Designation F1801-97 Standard Practice for Corrosion Fatigue Testing of Metallic Implant Materials" ASTM International (1997) pp. 876-880.

"ASTM Designation F2066-01 Standard Specification for Wrought Titanium-15 Molybdenum Alloy for Surgical Implant. Applications (UNS R58150)," ASTM International (2000) pp. 1-4.

AL-6XN® Alloy (UNS N08367) Allegheny Ludlum Corporation, 2002, 56 pages.

Allegheny Ludlum, "High Performance Metals for Industry, High Strength, High Temperature, and Corrosion-Resistant Alloys", (2000) pp. 1-8.

ALLVAC, Product Specification for "Allvac Ti—15 Mo" available at http://www.allvac.com/allvac/pages/Titanium/Ti15MO.htm, last visited Jun. 9, 2003 p. 1 of 1.

Altemp® A286 Iron-Base Superalloy (UNS Designation S66286) Allegheny Ludlum Technical Data Sheet Blue Sheet, 1998, 8 pages.

ASM Materials Engineering Dictionary, J.R. Davis Ed., ASM International, Materials Park, OH (1992) p. 39.

ATI Datalloy 2 Alloy, Technical Data Sheet, ATI Allvac, Monroe, NC, SS-844, Version 1, Sep. 17, 2010, 8 pages.

ATI 38-644™ Beta Titanium Alloy Technical Data Sheet, UNS R58640, Version 1, Dec. 21, 2011, 4 pages.

ATI 690 (UNS N06690) Nickel-Base, ATI Allvac, Oct. 5, 2010, 1 page.

Isothermal forging definition, ASM Materials Engineering Dictionary, J.R. Davis ed., Fifth Printing, Jan. 2006, ASM International, p. 238.

(56) References Cited

OTHER PUBLICATIONS

Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_ process, accessed May 21, 2013, 10 pages.
ASTM Designation F 2066-01. "Standard Specification for Wrought Titanium-15 Molybdenum Alloy for Surgical Implant Applications (UNS R56150)", May 2001, 7 pages.
ASTM Designation F 2066/F2066M-13, "Standard Specification for Wrought Titanium-15 Molybdenum Alloy for Surgical Implant Applications (UNS R58150)", Nov. 2013, 6 pages.
ATI 6-2-4-2™ Alloy Technical Data Sheet, Version 1, Feb. 26. 2012, 4 pages.
ATI 8-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 425® Alloy, Grade 38, Titanium Alloy, UNS R54250, Technical Data Sheet, Version 1, Nov. 25, 2013, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti—15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe-0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys—Cold Forming", ASM Handbook, 2006, ASM International, vol. 14B, 2 pages.
Beal et al., "Forming of Titanium and Titanium Alloys—Cold Forming", ASM Handbook, 2006, ASM International, Revised by ASM Committee on Forming Titanium Alloys, vol. 14B, 2 pages.
Beal et al., "Forming of Titanium and Titanium Alloys—Cold Forming", ASM Handbook, 2006, vol. 14B, pp. 656-669.
Bewlay, et al., "Superplastic roll forming of Ti alloys", Materials and Design, 21, 2000, pp. 287-295.
Bowen, A. W., "Omega Phase Embrittlement in Aged Ti—15% Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Boyko et al., "Modeling of the Open-Die and Radial Forging Processes for Alloy 718", Superalloys 718, 625 and Various Derivatives. Proceedings of the International Symposium on the Metallurgy and Applications of Superalloys 718, 625 and Various Derivatives, held Jun. 23, 1992, pp. 107-124.
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Craighead et al., "Ternary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Desrayaud et al., "A novel high straining process for bulk materials—The development of a rnultipass forging system by compression along three axes", Journal of Materials Processing Technology, 172, 2006, pp. 152-158.
Diderrich et al., "Addition of Cobalt to the Ti—6Al—4V Alloy", Journal of Metals, May 1968, pp. 29-37.
DiDomizio, et al., "Evaluation of a Ni—20Cr Alloy Processed by Multi-axis Forging", Materials Science Forum vols. 503-504, 2006, pp. 793-798.
Disegi, J. A , "Titanium Alloys for Fracture Fixation Implants," Injury International Journal of the Care of the Injured, vol. 31 (2000) pp. S-D14-S-D17.
Disegi, John, Wrought Titanium—15% Molybdenum Implant Material, Original Instruments and Implants of the Association for the Study of International Fixation—AO ASIF, Oct. 2003.
Donachie Jr., M.J., "Titanium A Technical Guide" 1988, ASM, pp. 39 and 46-50.
Donachie Jr., M.J., "Heat Treating Titanium and Its Alloys", Heat Treating Process, Jun./Jul. 2001, pp. 47-49, 52-53, and 56-57.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys—Solution Treating and Aging", ASM Handbook, 1991, ASM International, vol. 4, pp. 1-8.
Glazunov et al., Structural Titanium Alloys, Moscow, Metallurgy, 1974, pp. 264-283.
Greenfield, Dan L., News Release, ATI Aerospace Presents Results of Year-Long Characterization Program for New ATI 425 Alloy Titanium Products at Aeromat 2010, Jun. 21. 2010, Pittsburgh, Pennsylvania, 1 page.
Harper, Megan Lynn, "A Study of the Microstructural and Phase Evolutions in Timetal 555", Jan. 2004, retrieved From http://www.ohiolink.edu/etd/send-pdf.cgi/harper%20megan%20lynn.pdf?acc_num=su1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.

(56) References Cited

OTHER PUBLICATIONS

Hsieh, Chih-Chun and Weite Wu, "Overview of Intermetallic Sigma Phase Precipitation in Stainless Steels", ISRN Metallurgy, vol. 2012, 2012, pp, 1-16.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystanine structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging". Materials Science Forum, vols. 638-642, 2010, pp. 1702-1707.
Imperial Metal Industries Limited, Product Specification for "IMI Titanium 205", The Kynoch Press (England) pp. 1-5. (1965).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti—15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Probiemy Prochnosti. No. 5, pp. 105-110. May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials tor Surgical Implant Devices," BONEZone, Fall (2002) p. 5-9 and Table.
Long, M. et al., "Friction and Surface Behavior of Selected Titanium Alloys During Reciprocating-Sliding Motion", WEAR. 249(1-2), Jan. 17, 2001. 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications" Journal of ASTM International, vol. 2, Issue 9 (Oct. 2005) (published online Aug. 17, 2005).
Marquardt, Brian, "Characterization of Ti—15Mo for Orthopaedic Applications," TMS 2005 Annual Meeting: Technical Program, San Francisco, CA, Feb. 13-17, 2005 Abstract, p. 239.
Marquardt, Brian, "Ti—15Mo Beta Titanium Alloy Processed for High Strength Orthopaedic Applications," Program and Abstracts for The Symposium on Titanium, Niobium, Zirconium, and Tantalum for Medical and Surgical Applications, Washington, D.C., Nov. 9-10, 2004 Abstract, p. 11.
Marte et al., "Structure and Properties of Ni—20Cr Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Workind, A lesson from Titanium and its Alloys," ASM Course Book 27 Lesson, Test 9, Aug. 1994, pp. 3-4.
Naik, Lima M. et al., "Omega and Alpha Precipitation in Ti—15Mo Alloy,"Titanium '80 Science and Technology—Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Novikov et al., 17,2,2 Deformable ($\alpha$+$\beta$) alloys. Chapter 17, Titanium and its Alloys, Metal Science, vol. II Thermal Treatment of the Alloy, Physical Matallurgy, 2009, pp. 357-360.
Nutt, Michael J. et al., "The Application of Ti-15 Beta Titanium Alloy in High Strength Structural Orthopaedic Applications," Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for $\beta$ Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in $\beta$ Ti—15Mo," Titanium '80 Science and Technology—Proceedings of the 4th International Conference on Titanium, H. Kimura & O. Izumi Eds. May 19-22, 1980 pp. 1344-1350.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4. Ti—6Al—4V ELI, Ti—6A1—7 Nb, and Ti—15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001 p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et al., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti-6242S", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.

(56) References Cited

OTHER PUBLICATIONS

Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Serniatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titaniumm™ Titanium Fasteners, SPS Technologies Aerospace Fasteners, 2003, 4 pages.
Standard Specification for Wrought Titanium-6Aluminum-4Vanadium Alloy for Surgical Implant Applications (UNS R56400), Designation: F 1472-99, ASTM 1999, pp. 1-4.
Swann, P.R. and J. G. Parr, "Phase Transformations in Titanium-Rich Alloys of Titanium and Cobalt", Transactions of the Metallurgical Society of AIME, Apr. 1958, pp. 276-279.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Tamirisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V-xB Alloys: Processing, Microstructure, and Properties", JOM, May 2004, pp. 60-63.
Tebbe, Patrick A. and Ghassan T. Kridli, "Warm forming aluminum ailoys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
Ti—6Al—4V, Ti64, 6Al—4V, 6-4, UNS R856400, 1 page.
TIMET 6-6-2 Titanium Alloy (Ti—6Al—6V—2Sn), Annealed, accessed Jun. 27, 2012.
TIMET TIMETAL® 6-2-4-2 (Ti—6Al—2Sn—4Zr—2Mo—0.08Si) Titanium Alloy datasheet, accessed Jun. 26, 2012.
TIMET TIMETAL® 6-2-4-6 Titanium Alloy (Ti—6Al—2Sn—4Zr—6Mo), Typical, accessed Jun. 26, 2012.
Titanium 3Al—8V—6Cr—4Mo—4Zr Beta-C/Grade 19 UNS R58640. 2 pages.
Tokaji, Keiro et al., "The Microstructure Dependence of Fatigue Behavior in Ti—15Mo—5Zr—3Al Alloy," Materials Science and Engineering A , vol. 213 (1996) pp, 86-92.
Two new α-β titanium alloys, KS Ti-9 for sheet and KS EL-F for forging, with mechanical properties comparable to Ti—6Al—4V, Oct. 8, 2002. ITA 2002 Conference in Orlando, Hideto Oyama, Titanium Technology Dept., Kobe Steel, Ltd.. 16 pages.
Veeck, S., et al., "The Castability of Ti-5553 Alloy," Advanced Materials and Processes. Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998. pp. 46-65.
Williams, J., Thermo-mechanical processing of high-performance Ti alloys: recent progress and future needs, Journal of Material Processing Technology, 117 (2001), p. 370-373.
Yakymyshyn et al., "The Relationship between the Constitution and Mechanical Properties of Titanium-Rich Alloys of Titanium and Cobalt", 1961, vol. 53, pp. 283-294.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AerorMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004. pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007; SAE Aerospace, Aerospace Material Specification, 7 pages.
E112-12 Standard Test Methods for Determining Average Grain Size, ASTM International, Jan. 2013, 27 pages.
ATI Datalloy 2 Alloy, Technical Data Sheet, ATI Properties, Inc.. Version 1, Jan. 24, 2013, 6 pages.
ATI AL-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2. Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
AFML-TR-76-80 Development of Titanium Alloy Casting Technology, Aug. 1976, 5 pages.
Valiev et al., "Nanostructured materials produced by sever plastic deformation", Moscow, LOGOS, 2000.
Li et al., "The optimal determination of forging process parameters for Ti—6.5Al—3.5Mo—1.5.Zr—0.3Si alloy with thick lamellar microstructure in two phase field based on P-map", Journal of Materials Processing Technology, vol. 210, issue 2, Jan. 19, 2010, pp. 370-377.

(56) References Cited

OTHER PUBLICATIONS

Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.
Superaustenitic, http://www.atimetals.com/products/Pages/superaustenitic.aspx, Nov. 9, 2015, 3 pages.
French, D., "Austentic Stainless Steel", The National Board of Boiler and Pressure Vessel Inspectors Bulletin, 1992, 3 pages.
Acom Magazine. outokumpu. NACE International, Feb. 2013. 16 pages.
ATI A286™ Iron Based Superalloy (UNS S66286) Technical Data Sheet, Allegheny Technologies Incorporated, Version 1, Apr. 17, 2012, 9 pages.
ATI A286™ (UNS S66286) Technical Data Sheet, Allegheny Technologies Incorporated, Version 1. Mar. 14, 2012, 3 pages.
Corrosion-Resistant Titanium, Technical Data Sheet, Allegheny Technologies Incorporated, Version 1, Feb. 29, 2012, 5 pages.
ATI 32.5™ Titanium (Ti Grade 9) Technical Data Sheet, ATI Wah Chang. 2010, 4 pages.
Grade 9 Ti 3Al 2.5V Alloy (UNS R56320), Jul. 30, 2013. http://www.azom.com/article.aspx?AiticleID=9337, 3 pages.
ATI Ti—6Al—4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V-2Mo—2Fe Alloy, Jul. 9, 2013, http://www.azom.com/article.aspx?ArticleID=9448, 2 pages.
Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of TIMETAL® 54M", Henderson Technical Laboratory, Titanium Metals Corporation, ITA, Oct. 2010, Orlando, Florida, 18 pages.
Markovsky, P. E., "Preparation and properties of ultrafine (submicron) structure titanium alloys", Materials Science and Engineering, 1995, A203, 4 pages.
ATI Datalloy HP™ Alloy, UNS N08830, Technical Data Sheet Version 1, Apr. 14, 2015, 8 pages.
ATI Datalloy 2® Alloy, Technical Data Sheet, Version 1. Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://www.azom.com/article.aspx?ArticieID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng. et al. "Effects of Forging Process and Following Heat Treatment on Microstructure and Mechanical Properties of TC11 Titanium Alloy," Materials for Mechanical Engineering, vol. 36. No. 11, Nov. 2011, 5 pages. (English abstract included).
Srinivasan et al., "Rolling of Plates and Sheets from As-Cast Ti—6Al—4V—0.1 B", Journal of Materials Engineering and Performance, vol. 18.4, Jun. 2009, pp. 390-398.
Office Action dated Oct. 19. 2011 in U.S. Appl. No. 12/691,952.
Office Action dated Feb. 2, 2012 in U.S. Appl. No. 12/691,952.
Office Action dated Dec. 23, 2014 in U.S. Appl. No. 12/691,952.
Office Action dated Apr. 23, 2015 in U.S. Appl. No. 12/691,952.
Office Action dated Jul. 28, 2015 in U.S. Appl. No. 12/691,952.
Office Action dated Feb. 17, 2016 in U.S. Appl. No. 12/691,952.
Office Action dated Jun. 28, 2016 in U.S. Appl. No. 12/691,952.
Applicant-Initiated Interview Summary dated Aug. 22, 2016 in U.S. Appl. No. 12/691,952.
Advisory Action Before the Filing of an Appeal Brief dated Aug. 30, 2016 in U.S. Appl. No. 12/691,952.
Office Action dated Apr. 28, 2017 in U.S. Appl. No. 12/691,952.
Office Action dated Jul. 10, 2017 in U.S. Appl. No. 12/691,952.
Advisory Action dated Aug. 7, 2017 in U.S. Appl. No. 12/691,952.
Office Action dated Feb. 20, 2004 in U.S. Appl. No. 10/165,348.
Office Action dated Oct. 26, 2004 in U.S. Appl. No. 10/165,348.
Office Action dated Feb. 16, 2005 in U.S. Appl. No. 10/165,348.
Office Action dated Jul. 25, 2005 in U.S. Appl. No. 10/165,348.
Office Action dated Jan. 3, 2006 in U.S. Appl. No. 10/165,348.
Office Action dated Dec. 16, 2004 in U.S. Appl. No. 10/434,598.
Office Action dated Aug. 17, 2005 in U.S. Appl. No. 10/434,598.
Office Action dated Dec. 19, 2005 in U.S. Appl. No. 10/434,598.
Office Action dated Sep. 6, 2006 in U.S. Appl. No. 10/434,598.
Office Action dated Aug. 6, 2008 in U.S. Appl. No. 11/448,160.
Office Action dated Jan. 13, 2009 in U.S. Appl. No. 11/448,160.
Notice of Allowance dated Apr. 13, 2010 in U.S. Appl. No. 11/448,160.
Notice of Allowance dated Sep. 20, 2010 in U.S. Appl. No. 11/448,160.
Office Action dated Sep. 26, 2007 in U.S. Appl. No. 11/057,614.
Office Action dated Jan. 10, 2008 in U.S. Appl. No. 11/057,614.
Office Action dated Aug. 29, 2008 in U.S. Appl. No. 11/057,614.
-Office Action dated Aug. 11, 2009 in U.S. Appl. No. 11/057,614.
Office Action dated Jan. 14, 2010 in U.S. Appl. No. 11/057,614.
Interview summary dated Apr. 14, 2010 in U.S. Appl. No. 11/057,614.
Office Action dated Jun. 21 2010 in U.S. Appl. No. 11/057,614.
Notice of Allowance dated Sep. 3, 2010 in U.S. Appl. No. 11/057,614.
Office Action dated Apr. 1, 2010 in U.S. Appl. No. 11/745,189.
Interview summary dated Jun. 3, 2010 in U.S. Appl. No. 11/745,189.
Interview summay dated Jun. 15, 2010 in U.S. Appl. No. 11/745,189.
Office Action dated Nov. 24, 2010 in U.S. Appl. No. 11/745,189.
Interview summary dated Jan. 6, 2011 in U.S. Appl. No. 11/745,189.
Notice of Allowance dated Jun. 27, 2011 in U.S. Appl. No. 11/745,189.
Office Action dated Jan. 11, 2011 in U.S. Appl. No. 12/911,947.
Office Action dated Aug. 4, 2011 in U.S. Appl. No. 12/911,947.
Office Action dated Nov. 16, 2011 in U.S. Appl. No. 12/911,947.
Advisory Action dated Jan. 25, 2012 in U.S. Appl. No. 12/911,947.
Notice of Panel Decision from Pre-Appeal Brief Review mailed Mar. 28, 2012 in U.S. Appl. No. 12/911,947.
Office Action dated Apr. 5, 2012 in U.S. Appl. No. 12/911,947.
Office Action dated Sep. 19, 2012 in U.S. Appl. No. 12/911,947.
Advisory Action dated Nov. 29, 2012 in U.S. Appl. No. 12/911,947.
Office Action dated May 31, 2013 in U.S. Appl. No. 12/911,947.
Notice of Allowance dated Oct. 4, 2013 in U.S. Appl. No. 12/911,947.
Office Action dated Jan. 3, 2011 in U.S. Appl. No. 12/857,789.
Office Action dated Jul. 27, 2011 in U.S. Appl. No. 12/857,789.
Advisory Action dated Oct. 7. 2011 in U.S. Appl. No. 12/857,789.
Notice of Allowance dated Jul. 1, 2013 in U.S. Appl. No. 12/857,789.
Office Action dated Nov. 14, 2012 in U.S. Appl. No. 12/885,620.
Office Action dated Jun. 13, 2013 in U.S. Appl. No. 12/885,620.
Office Action dated Nov. 19, 2013 in U.S. Appl. No. 12/885,620.
Advisory Action Before the Filing of an Appeal Brief mailed Jan. 30, 2014 in U.S. Appl. No. 12/885,820.
Office Action dated Jun. 18. 2014 in U.S. Appl. No. 12/885,620.
Office Action dated Nov. 28, 2014 in U.S. Appl. No. 12/885,620.

(56) References Cited

OTHER PUBLICATIONS

Advisory Action dated May 18, 2015 in U.S. Appl. No. 12/885,620.
Office Action dated Jun. 30, 2015 in U.S. Appl. No. 12/885,620.
Notice of Abandonment dated Jan. 29, 2016 in U.S. Appl. No. 12/885,620.
Office Action dated Nov. 14, 2012 in U.S. Appl. No. 12/888,699.
.Office Action dated Oct. 3, 2012 in U.S. Appl. No. 12/838,674.
Office Action dated Jul. 18, 2013 in U.S. Appl. No. 12/838,674.
Office Action dated May 27, 2015 in U.S. Appl. No. 12/838,674.
Applicant Initiated Interview Summary dated Sep. 1, 2015 in U.S. Appl. No. 12/838,674.
Notice of Allowance dated Sep. 25, 2015 in U.S. Appl. No. 12/838,674.
Office Action dated Sep. 26, 2012 in U.S. Appl. No. 12/845,122.
Notice of Allowance dated Apr. 17, 2013 in U.S. Appl. No. 12/845,122.
Office Action dated Dec. 24, 2012 in U.S. Appl. No. 13/230,046.
Notice of Allowance dated Jul. 31. 2013 in U.S. Appl. No. 13/230,046.
Office Action dated Dec. 26, 2012 in U.S. Appl. No. 13/230,143.
Notice of Allowance dated Aug. 2, 2013 in U.S. Appl. No. 13/230,143.
Office Action dated Mar. 1, 2013 in U.S. Appl. No. 12/903,851.
Office Action dated Jan. 16, 2014 in U.S. Appl. No. No. 12/903,851.
Office Action dated Oct. 6, 2014 in U.S. Appl. No. 12/903,851.
Office Action dated Jul. 15. 2015 in U.S. Appl. No. 12/903,851.
Examiner's Answer to Appeal Brief dated Oct. 27, 2016 in U.S. Appl. No. 12/903,851.
Office Action dated Mar. 25, 2013 in U.S. Appl. No. 13/108,045.
Office Action dated Jan. 17, 2014 in U.S. Appl. No. 13/108,045.
Office Action dated Mar. 30, 2016 in U.S. Appl. No. 13/108,045.
Office Action dated Sep. 9, 2016 in U.S. Appl. No. 13/108,045.
Advisory Action dated Mar. 7, 2017 in U.S. Appl. No. 13/108,045.
Office Action dated Apr. 16, 2013 in U.S. Appl. No. 13/150,494.
Office Action dated Jun. 14, 2013 in U.S. Appl. No. 13/150,494.
Notice of Allowance dated Nov. 5, 2013 in U.S. Appl. No. 13/150,494.
Supplemental Notice of Allowability dated Jan. 17, 2014 in U.S. Appl. No. 13/150,494.
U.S. Appl. No. 13/331,135, filed Dec. 20, 2011.
Office Action dated Jan. 21, 2015 in U.S. Appl. No. 13/792,285.
Office Action dated Jun. 4, 201 5 in U.S. Appl. No. 13/792,285.
Notice of Allowance dated Sep. 16, 2015 in U.S. Appl. No. 13/792,285.
Response to Rule 312 Communication dated Oct. 20, 2015 in U.S. Appl. No. 13/792,285.
Notice of Allowance dated Oct. 24, 2014 in U.S. Appl. No. 13/844,545.
Notice of Allowance dated Feb. 6, 2015 in U.S. Appl. No. 13/844,545.
Office Action dated Jan. 23, 2013 in U.S. Appl. No. 12/882,538.
Office Action dated Feb. 8, 2013 in U.S. Appl. No. 12/882,538.
Notice of Allowance dated Jun. 24, 2013 in U.S. Appl. No. 12/882,538.
Office Action dated Sep. 6, 2013 in U.S. Appl. No. 13/933,222.
Notice of Allowance dated Oct. 1, 2013 in U.S. Appl. No. 13/933,222.
Notice of Allowance dated May 6, 2014 in U.S. Appl. No. 13/933,222.
Office Action dated Jun. 3, 2015 in U.S. Appl. No. 13/714,465.
Office Action dated Jul. 8, 2015 in U.S. Appl. No. 13/714,465.
Notice of Allowance dated Sep. 2, 2015 in U.S. Appl. No. 13/714,465.
Response to Rule 312 Communication dated Sep. 29, 2015 in U.S. Appl. No. 13/714,465.
Response to Rule 312 Communication dated Oct. 8, 2015 in U.S. Appl. No. 13/714,465.
Office Action dated Jun. 26, 2015 in U.S. Appl. No. 13/777,066.
Office Action dated Oct. 5, 2015 in U.S. Appl. No. 13/777,066.
Advisory Action Before the Filing of an Appeal Brief dated Mar. 17, 2016 in U.S. Appl. No. 13/777,066.
Office Action dated Jul. 22, 2016 in U.S. Appl. No. 13/777,066.
Office Action dated Oct. 12. 2016 in U.S. Appl. No. 13/777,066.
Office Action dated May 18, 2017 in U.S. Appl. No. 13/777,066.
Advisory Action Before the Filing of an Appeal Brief dated Jul. 10, 2017 in U.S. Appl. No. 13/777,066.
Notice of Allowance dated Aug. 30, 2017 in U.S. Appl. No. 13/777,066.
Office Action dated Aug. 19, 2015 in U.S. Appl. No. 13/844,196.
Office Action dated Oct. 15, 2015 in U.S. Appl. No. 13/844,196.
Office Action dated Feb. 12, 2016 in U.S. Appl. No. 13/844,196.
Advisory Action Before the Filing of an Appeal Brief dated Jun. 15, 2016 in U.S. Appl. No. 13/844,196.
Office Action dated Aug. 22, 2016 in U.S. Appl. No. 13/844,196.
Office Action dated Dec. 29, 2016 in U.S. Appl. No. 13/844,196.
Notice of Allowance dated Jul. 13, 2017 in U.S. Appl. No. 13/844,196.
Corrected Notice of Allowability dated Jul. 20, 2017 in U.S. Appl. No. 13/844,196.
Corrected Notice of Allowability dated Aug. 18, 2017 in U.S. Appl. No. 13/844,196.
Office Action dated Oct. 2, 2015 in U.S. Appl. No. 14/073,029.
Office Action dated Aug. 12, 2016 in U.S. Appl. No. 14/073,029.
Office Action dated Jun. 14, 2017 in U.S. Appl. No. 14/073,029.
Notice of Allowance dated Jul. 7, 2017 in U.S. Appl. No. 14/073,029.
Notice of Allowability dated Sep. 21, 2017 in U.S. Appl. No. 14/073,029.
Office Action dated Oct. 28, 2015 in U.S. Appl. No. 14/093,707.
Office Action dated Mar. 17, 2016 in U.S. Appl. No. 14/093,707.
Advisory Action Before the Filing of an Appeal Brief dated Jun. 10, 2016 in U.S. Appl. No. 14/093,707.
Office Action dated Sep. 30, 2016 in U.S. Appl. No. 14/093,707.
Notice of Allowance dated Jan. 13, 2017 in U.S. Appl. No. 14/093,707.
Supplemental Notice of Allowance dated Jan. 27, 2017 in U.S. Appl. No. 14/093,707.
Supplemental Notice of Allowance dated Feb. 10, 2017 in U.S. Appl. No. 14/093,707.
Supplemental Notice of Allowability dated Mar. 1, 2017 in U.S. Appl. No. 14/093,707.
Notice of Third-Party Submission dated Dec. 16, 2015 in U.S. Appl. No. 14/077,699.
Office Action dated Jul. 25, 2016 in U.S. Appl. No. 14/077,699.
Office Action dated Aug. 16, 2016 in U.S. Appl. No. 14/077,699.
Office Action dated Oct. 25, 2016 in U.S. Appl. No. 14/077,699.
Advisory Action dated Nov. 30, 2016 in U.S. Appl. No. 14/077,699.
Office Action dated Mar. 16, 2016 in U.S. Appl. No. 15/005,281.
Office Action dated Aug. 26, 2016 in U.S. Appl. No. 15/005,281.
Notice of Panel Decision from Pre-Appeal Brief Review mailed Feb. 24, 2017 in U.S. Appl. No. 15/005,281.
Office Action dated Mar. 2, 2017 in U.S. Appl. No. 15/005,281.
Notice of Allowance dated May 10, 2017 in U.S. Appl. No. 15/005,281.
Corrected Notice of Allowability dated Aug. 9, 2017 in U.S. Appl. No. 15/005,281.
Office Action dated Apr. 5, 2016 in U.S. Appl. No. 14/028,588.
Office Action dated Aug. 8, 2016 in U.S. Appl. No. 14/028,588.
Advisory Action dated Oct. 14, 2016 in U.S. Appl. No. 14/028,588.
Applicant Initiated Interview Summary dated Oct. 27, 2016 in U.S. Appl. No. 14/028,588.
Office Action dated Mar. 15, 2017 in U.S. Appl. No. 14/028,588.
Office Action dated Jul. 14, 2017 in U.S. Appl. No. 14/028,588.
Advisory Action dated Sep. 12, 2017 in U.S. Appl. No. 14/028,588.
Office Action dated Apr. 13, 2016 in U.S. Appl. No. 14/083,759.
Office Action dated May 6, 2016 in U.S. Appl. No. 14/083,759.
Notice of Allowance dated Oct. 13, 2016 in U.S. Appl. No. 14/083,759.
Notice of Allowance dated Dec. 16, 2016 in U.S. Appl. No. 14/922,750.
Notice of Allowance dated Feb. 28, 2017 in U.S. Appl. No. 14/922,750.
Office Action dated Apr. 10, 2017 in U.S. Appl. No. 14/594,300.
Office Action dated May 25, 2017 in U.S. Appl. No. 14/594,300.
Office Action dated Sep. 13, 2017 in U.S. Appl. No. 14/594,300.
U.S. Appl. No. 15/348,140, filed Nov. 10, 2016.
Gil et ai., "Formation of alpha-Widmanstatten structure: effects of grain size and cooling rate on the Widmanstatten morphologies and on the mechanical properties in Ti6Al4V alloy", Journal of Alloys and Compounds, 329, 2001, pp. 142-152.

(56) References Cited

OTHER PUBLICATIONS

Enayati et al., "Effects of temperature and effective strain on the flow behavior of Ti—6Al—4V", Journal of the Franklin Institute, 348, 2011, pp. 2813-2822.
Longxian et al., "Wear-Resistant Coating and Performance Titanium and Its Alloy, and properties thereof", Northeastern University Press, Dec. 2006, pp. 26-28, 33.
"Acceleration and Improvement for Heat Treating Workers," Quick Start and Improvement for Heat Treatment, ed. Yang Man, China Machine Press, Apr. 2008, pp. 265-266.
Decision on Appeal dated Dec. 15, 2017 in U.S. Appl. No. 12/903,851.
Office Action dated Dec. 1, 2017 in U.S. Appl. No. 14/077,699.
Notice of Panel Decision from Pre-Appeal Brief Review dated Oct. 27, 2017 in U.S. Appl. No. 14/028,588.
Office Action dated Dec. 6, 2017 in U.S. Appl. No. 14/948,941.
Office Action dated Apr. 6, 2018 in U.S. Appl. No. 12/903,851.
Office Action dated Feb. 27, 2018 in U.S. Appl. No. 13/108,045.
Corrected Notice of Allowability dated Dec. 20, 2017 in U.S. Appl. No. 13/777,066.
Interview Summary dated Mar. 12, 2018 in U.S. Appl. No. 14/077,699.
Notice of Allowance dated Feb. 9, 2018 in U.S. Appl. No. 14/028,588.
Advisory Action dated Jan. 26, 2018 in U.S. Appl. No. 14/594,300.
Office Action dated Feb. 28, 2018 in U.S. Appl. No. 14/594,300.
Office Action dated Feb. 15, 2018 in U.S. Appl. No. 14/948,941.
Office Action dated Apr. 2, 2018 in U.S. Appl. No. 14/881,633.
Forging Machinery, Dies, Processes, Metals Handbook Desk Edition, ASM International, 198, pp. 839-863.
Smith, et al. "Types of Heat-Treating Furnaces," Heat Treating, ASM Handbook, ASM International, 1991, vol. 4, p. 465-474.

PROCESSING OF ALPHA/BETA TITANIUM ALLOYS

CROSS-REFERENCE TO RELATED APPLICATIONS

This patent application is a continuation application claiming priority under 35 U.S.C. § 120 to co-pending U.S. application Ser. No. 15/005,281, filed on Jan. 25, 2016, which is a continuation of U.S. application Ser. No. 12/838,674, filed on Jul. 19, 2010, and which issued as U.S. Pat. No. 9,255,316. Each such patent application is hereby incorporated herein by reference.

TECHNICAL FIELD

This disclosure is directed to processes for producing high strength alpha/beta (α+β) titanium alloys and to products produced by the disclosed processes.

BACKGROUND

Titanium and titanium-based alloys are used in a variety of applications due to the relatively high strength, low density, and good corrosion resistance of these materials. For example, titanium and titanium-based alloys are used extensively in the aerospace industry because of the materials' high strength-to-weight ratio and corrosion resistance. One groups of titanium alloys known to be widely used in a variety of applications are the alpha/beta (α+β) Ti-6Al-4V alloys, comprising a nominal composition of 6 percent aluminum, 4 percent vanadium, less than 0.20 percent oxygen, and titanium, by weight.

Ti-6Al-4V alloys are one of the most common titanium-based manufactured materials, estimated to account for over 50% of the total titanium-based materials market. Ti-6Al-4V alloys are used in a number of applications that benefit from the alloys' combination of high strength at low to moderate temperatures, light weight, and corrosion resistance. For example, Ti-6Al-4V alloys are used to produce aircraft engine components, aircraft structural components, fasteners, high-performance automotive components, components for medical devices, sports equipment, components for marine applications, and components for chemical processing equipment.

Ti-6Al-4V alloy mill products are generally used in either a mill annealed condition or in a solution treated and aged (STA) condition. Relatively lower strength Ti-6Al-4V alloy mill products may be provided in a mill-annealed condition. As used herein, the "mill-annealed condition" refers to the condition of a titanium alloy after a "mill-annealing" heat treatment in which a workpiece is annealed at an elevated temperature (e.g., 1200-1500° F./649-816° C.) for about 1-8 hours and cooled in still air. A mill-annealing heat treatment is performed after a workpiece is hot worked in the α+β phase field. Ti-6Al-4V alloys in a mill-annealed condition have a minimum specified ultimate tensile strength of 130 ksi (896 MPa) and a minimum specified yield strength of 120 ksi (827 MPa), at room temperature. See, for example, Aerospace Material Specifications (AMS) 4928 and 6931A, which are incorporated by reference herein.

To increase the strength of Ti-6Al-4V alloys, the materials are generally subjected to an STA heat treatment. STA heat treatments are generally performed after a workpiece is hot worked in the α+β phase field. STA refers to heat treating a workpiece at an elevated temperature below the β-transus temperature (e.g., 1725-1775° F./940-968° C.) for a relatively brief time-at-temperature (e.g., about 1 hour) and then rapidly quenching the workpiece with water or an equivalent medium. The quenched workpiece is aged at an elevated temperature (e.g., 900-1200° F./482-649° C.) for about 4-8 hours and cooled in still air. Ti-6Al-4V alloys in an STA condition have a minimum specified ultimate tensile strength of 150-165 ksi (1034-1138 MPa) and a minimum specified yield strength of 140-155 ksi (965-1069 MPa), at room temperature, depending on the diameter or thickness dimension of the STA-processed article. See, for example, AMS 4965 and AMS 6930A, which is incorporated by reference herein.

However, there are a number of limitations in using STA heat treatments to achieve high strength in Ti-6Al-4V alloys. For example, inherent physical properties of the material and the requirement for rapid quenching during STA processing limit the article sizes and dimensions that can achieve high strength, and may exhibit relatively large thermal stresses, internal stresses, warping, and dimensional distortion. This disclosure is directed to methods for processing certain α+β titanium alloys to provide mechanical properties that are comparable or superior to the properties of Ti-6Al-4V alloys in an STA condition, but that do not suffer from the limitations of STA processing.

SUMMARY

Embodiments disclosed herein are directed to processes for forming an article from an α+β titanium alloy. The processes comprise cold working the α+β titanium alloy at a temperature in the range of ambient temperature to 500° F. (260° C.) and, after the cold working step, aging the α+β titanium alloy at a temperature in the range of 700° F. to 1200° F. (371-649° C.). The α+β titanium alloy comprises, in weight percentages, from 2.90% to 5.00% aluminum, from 2.00% to 3.00% vanadium, from 0.40% to 2.00% iron, from 0.10% to 0.30% oxygen, incidental impurities, and titanium.

It is understood that the invention disclosed and described herein is not limited to the embodiments disclosed in this Summary.

BRIEF DESCRIPTION OF THE DRAWINGS

The characteristics of various non-limiting embodiments disclosed and described herein may be better understood by reference to the accompanying figures, in which.

Figure 1:
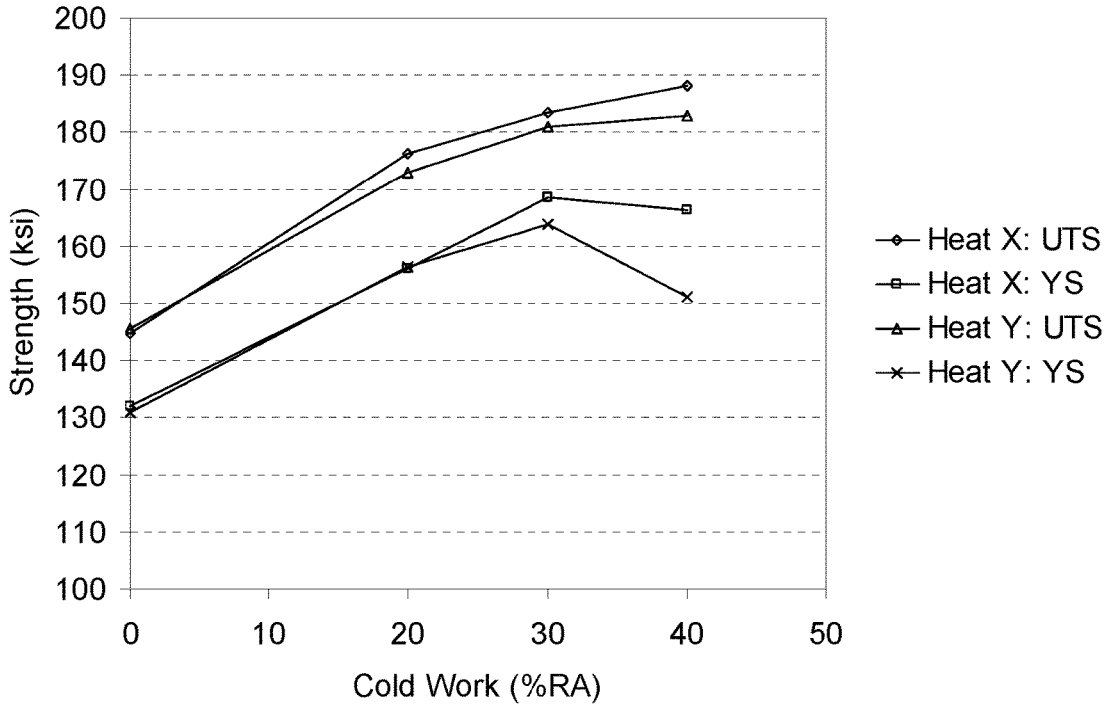
FIG. 1 is a graph of average ultimate tensile strength and average yield strength versus cold work quantified as percentage reductions in area (% RA) for cold drawn α+β titanium alloy bars in an as-drawn condition.

The reader will appreciate the foregoing details, as well as others, upon considering the following detailed description of various non-limiting embodiments according to the present disclosure. The reader may also comprehend additional details upon implementing or using embodiments described herein.

DETAILED DESCRIPTION OF NON-LIMITING EMBODIMENTS

It is to be understood that the descriptions of the disclosed embodiments have been simplified to illustrate only those features and characteristics that are relevant to a clear understanding of the disclosed embodiments, while eliminating, for purposes of clarity, other features and characteristics. Persons having ordinary skill in the art, upon considering this description of the disclosed embodiments, will recognize that other features and characteristics may be desirable in a particular implementation or application of the disclosed embodiments. However, because such other features and characteristics may be readily ascertained and implemented by persons having ordinary skill in the art upon considering this description of the disclosed embodiments, and are, therefore, not necessary for a complete understanding of the disclosed embodiments, a description of such features, characteristics, and the like, is not provided herein. As such, it is to be understood that the description set forth herein is merely exemplary and illustrative of the disclosed embodiments and is not intended to limit the scope of the invention defined by the claims.

In the present disclosure, other than where otherwise indicated, all numerical parameters are to be understood as being prefaced and modified in all instances by the term "about", in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed within the recited range. For example, a range of "1 to 10" is intended to include all sub-ranges between (and including) the recited minimum value of 1 and the recited maximum value of 10, that is, having a minimum value equal to or greater than 1 and a maximum value equal to or less than 10. Any maximum numerical limitation recited herein is intended to include all lower numerical limitations subsumed therein and any minimum numerical limitation recited herein is intended to include all higher numerical limitations subsumed therein. Accordingly, Applicant reserves the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. § 112, first paragraph, and 35 U.S.C. § 132(a).

The grammatical articles "one", "a", "an", and "the", as used herein, are intended to include "at least one" or "one or more", unless otherwise indicated. Thus, the articles are used herein to refer to one or more than one (i.e., to "at least one") of the grammatical objects of the article. By way of example, "a component" means one or more components, and thus, possibly, more than one component is contemplated and may be employed or used in an implementation of the described embodiments.

Any patent, publication, or other disclosure material that is said to be incorporated by reference herein, is incorporated herein in its entirety unless otherwise indicated, but only to the extent that the incorporated material does not conflict with existing definitions, statements, or other disclosure material expressly set forth in this description. As such, and to the extent necessary, the express disclosure as set forth herein supersedes any conflicting material incorporated by reference herein. Any material, or portion thereof, that is said to be incorporated by reference herein, but which conflicts with existing definitions, statements, or other disclosure material set forth herein is only incorporated to the extent that no conflict arises between that incorporated material and the existing disclosure material. Applicant reserves the right to amend the present disclosure to expressly recite any subject matter, or portion thereof, incorporated by reference herein.

The present disclosure includes descriptions of various embodiments. It is to be understood that the various embodiments described herein are exemplary, illustrative, and non-limiting. Thus, the present disclosure is not limited by the description of the various exemplary, illustrative, and non-limiting embodiments. Rather, the invention is defined by the claims, which may be amended to recite any features or characteristics expressly or inherently described in or otherwise expressly or inherently supported by the present disclosure. Further, Applicant reserves the right to amend the claims to affirmatively disclaim features or characteristics that may be present in the prior art. Therefore, any such amendments would comply with the requirements of 35 U.S.C. § 112, first paragraph, and 35 U.S.C. § 132(a). The various embodiments disclosed and described herein can comprise, consist of, or consist essentially of the features and characteristics as variously described herein.

The various embodiments disclosed herein are directed to thermomechanical processes for forming an article from an α+β titanium alloy having a different chemical composition than Ti-6Al-4V alloys. In various embodiments, the α+β titanium alloy comprises, in weight percentages, from 2.90 to 5.00 aluminum, from 2.00 to 3.00 vanadium, from 0.40 to 2.00 iron, from 0.20 to 0.30 oxygen, incidental impurities, and titanium. These α+β titanium alloys (which are referred to herein as "Kosaka alloys") are described in U.S. Pat. No. 5,980,655 to Kosaka, which is incorporated by reference herein. The nominal commercial composition of Kosaka alloys includes, in weight percentages, 4.00 aluminum, 2.50 vanadium, 1.50 iron, 0.25 oxygen, incidental impurities, and titanium, and may be referred to as Ti-4Al-2.5V-1.5Fe-0.250 alloy.

U.S. Pat. No. 5,980,655 ("the '655 patent") describes the use of α+β thermomechanical processing to form plates from Kosaka alloy ingots. Kosaka alloys were developed as a lower cost alternative to Ti-6Al-4V alloys for ballistic armor plate applications. The α+β thermomechanical processing described in the '655 patent includes:

(a) forming an ingot having a Kosaka alloy composition;

(b) β forging the ingot at a temperature above the β-transus temperature of the alloy (for example, at a temperature above 1900° F. (1038° C.)) to form an intermediate slab;

(c) α+β forging the intermediate slab at a temperature below the β-transus temperature of the alloy but in the α+β phase field, for example, at a temperature of 1500-1775° F. (815-968° C.);

(d) α+β rolling the slab to final plate thickness at a temperature below the β-transus temperature of the alloy but in the α+β phase field, for example, at a temperature of 1500-1775° F. (815-968° C.); and (e) mill-annealing at a temperature of 1300-1500° F. (704-815° C.).

The plates formed according to the processes disclosed in the '655 patent exhibited ballistic properties comparable or superior to Ti-6Al-4V plates. However, the plates formed according to the processes disclosed in the '655 patent exhibited room temperature tensile strengths less than the high strengths achieved by Ti-6Al-4V alloys after STA processing.

Ti-6Al-4V alloys in an STA condition may exhibit an ultimate tensile strength of about 160-177 ksi (1103-1220 MPa) and a yield strength of about 150-164 ksi (1034-1131 MPa), at room temperature. However, because of certain physical properties of Ti-6Al-4V, such as relatively low thermal conductivity, the ultimate tensile strength and yield strength that can be achieved with Ti-6Al-4V alloys through STA processing is dependent on the size of the Ti-6Al-4V alloy article undergoing STA processing. In this regard, the relatively low thermal conductivity of Ti-6Al-4V alloys limits the diameter/thickness of articles that can be fully hardened/strengthened using STA processing because internal portions of large diameter or thick section alloy articles do not cool at a sufficient rate during quenching to form alpha-prime phase (α'-phase). In this manner, STA processing of large diameter or thick section Ti-6Al-4V alloys produces an article having a precipitation strengthened case surrounding a relatively weaker core without the same level of precipitation strengthening, which can significantly decrease the overall strength of the article. For example, the strength of Ti-6Al-4V alloy articles begins to decrease for articles having small dimensions (e.g., diameters or thicknesses) greater than about 0.5 inches (1.27 cm), and STA processing does not provide any benefit to of Ti-6Al-4V alloy articles having small dimensions greater than about 3 inches (7.62 cm).

The size dependency of the tensile strength of Ti-6Al-4V alloys in an STA condition is evident in the decreasing strength minimums corresponding to increasing article sizes for material specifications, such as AMS 6930A, in which the highest strength minimums for Ti-6Al-4V alloys in an STA condition correspond to articles having a diameter or thickness of less than 0.5 inches (1.27 cm). For example, AMS 6930A specifies a minimum ultimate tensile strength of 165 ksi (1138 MPa) and a minimum yield strength of 155 ksi (1069 MPa) for Ti-6Al-4V alloy articles in an STA condition and having a diameter or thickness of less than 0.5 inches (1.27 cm).

Further, STA processing may induce relatively large thermal and internal stresses and cause warping of titanium alloy articles during the quenching step. Notwithstanding its limitations, STA processing is the standard method to achieve high strength in Ti-6Al-4V alloys because Ti-6Al-4V alloys are not generally cold deformable and, therefore, cannot be effectively cold worked to increase strength. Without intending to be bound by theory, the lack of cold deformability/workability is generally believed to be attributable to a slip banding phenomenon in Ti-6Al-4V alloys.

The alpha phase (α-phase) of Ti-6Al-4V alloys precipitates coherent $Ti_3Al$ (alpha-two) particles. These coherent alpha-two ($\alpha_2$) precipitates increase the strength of the alloys, but because the coherent precipitates are sheared by moving dislocations during plastic deformation, the precipitates result in the formation of pronounced, planar slip bands within the microstructure of the alloys. Further, Ti-6Al-4V alloy crystals have been shown to form localized areas of short range order of aluminum and oxygen atoms, i.e., localized deviations from a homogeneous distribution of aluminum and oxygen atoms within the crystal structure. These localized areas of decreased entropy have been shown to promote the formation of pronounced, planar slip bands within the microstructure of Ti-6Al-4V alloys. The presence of these microstructural and thermodynamic features within Ti-6Al-4V alloys may cause the entanglement of slipping dislocations or otherwise prevent the dislocations from slipping during deformation. When this occurs, slip is localized to pronounced planar regions in the alloy referred to as slip bands. Slip bands cause a loss of ductility, crack nucleation, and crack propagation, which leads to failure of Ti-6Al-4V alloys during cold working.

Consequently, Ti-6Al-4V alloys are generally worked (e.g., forged, rolled, drawn, and the like) at elevated temperatures, generally above the $\alpha_2$ solvus temperature. Ti-6Al-4V alloys cannot be effectively cold worked to increase strength because of the high incidence of cracking (i.e., workpiece failure) during cold deformation. However, it was unexpectedly discovered that Kosaka alloys have a substantial degree of cold deformability/workability, as described in U.S. Patent Application Publication No. 2004/0221929, which is incorporated by reference herein.

It has been determined that Kosaka alloys do not exhibit slip banding during cold working and, therefore, exhibit significantly less cracking during cold working than Ti-6Al-4V alloy. Not intending to be bound by theory, it is believed that the lack of slip banding in Kosaka alloys may be attributed to a minimization of aluminum and oxygen short range order. In addition, $\alpha_2$-phase stability is lower in Kosaka alloys relative to Ti-6Al-4V for example, as demonstrated by equilibrium models for the $\alpha_2$-phase solvus temperature (1305° F./707° C. for Ti-6Al-4V (max. 0.15 wt. % oxygen) and 1062° F./572° C. for Ti-4Al-2.5V-1.5Fe-0.250, determined using Pandat software, CompuTherm LLC, Madison, Wis., USA). As a result, Kosaka alloys may be cold worked to achieve high strength and retain a workable level of ductility. In addition, it has been found that Kosaka alloys can be cold worked and aged to achieve enhanced strength and enhanced ductility over cold working alone. As such, Kosaka alloys can achieve strength and ductility comparable or superior to that of Ti-6Al-4V alloys in an STA condition, but without the need for, and limitations of, STA processing.

In general, "cold working" refers to working an alloy at a temperature below that at which the flow stress of the material is significantly diminished. As used herein in connection with the disclosed processes, "cold working", "cold worked", "cold forming", and like terms, or "cold" used in connection with a particular working or forming technique, refer to working or the characteristics of having been worked, as the case may be, at a temperature no greater than about 500° F. (260° C.). Thus, for example, a drawing operation performed on a Kosaka alloy workpiece at a temperature in the range of ambient temperature to 500° F. (260° C.) is considered herein to be cold working. Also, the terms "working", "forming", and "deforming" are generally used interchangeably herein, as are the terms "workability", "formability", "deformability", and like terms. It will be understood that the meaning applied to "cold working", "cold worked", "cold forming", and like terms, in connection with the present application, is not intended to and does not limit the meaning of those terms in other contexts or in connection with other inventions.

In various embodiments, the processes disclosed herein may comprise cold working an α+β titanium alloy at a temperature in the range of ambient temperature up to 500° F. (260° C.). After the cold working operation, the α+β titanium alloy may be aged at a temperature in the range of 700° F. to 1200° F. (371-649° C.).

When a mechanical operation, such as, for example, a cold draw pass, is described herein as being conducted, performed, or the like, at a specified temperature or within a specified temperature range, the mechanical operation is performed on a workpiece that is at the specified temperature or within the specified temperature range at the initiation of the mechanical operation. During the course of a mechanical operation, the temperature of a workpiece may vary from the initial temperature of the workpiece at the initiation of the mechanical operation. For example, the temperature of a workpiece may increase due to adiabatic heating or decease due to conductive, convective, and/or radiative cooling during a working operation. The magnitude and direction of the temperature variation from the initial temperature at the initiation of the mechanical operation may depend upon various parameters, such as, for example, the level of work performed on the workpiece, the stain rate at which working is performed, the initial temperature of the workpiece at the initiation of the mechanical operation, and the temperature of the surrounding environment.

When a thermal operation such as an aging heat treatment is described herein as being conducted at a specified temperature and for a specified period of time or within a specified temperature range and time range, the operation is performed for the specified time while maintaining the workpiece at temperature. The periods of time described herein for thermal operations such as aging heat treatments do not include heat-up and cool-down times, which may depend, for example, on the size and shape of the workpiece.

In various embodiments, an α+β titanium alloy may be cold worked at a temperature in the range of ambient temperature up to 500° F. (260° C.), or any sub-range therein, such as, for example, ambient temperature to 450° F. (232° C.), ambient temperature to 400° F. (204° C.), ambient temperature to 350° F. (177° C.), ambient temperature to 300° F. (149° C.), ambient temperature to 250° F. (121° C.), ambient temperature to 200° F. (93° C.), or ambient temperature to 150° F. (65° C.). In various embodiments, an α+β titanium alloy is cold worked at ambient temperature.

In various embodiments, the cold working of an α+β titanium alloy may be performing using forming techniques including, but not necessarily limited to, drawing, deep drawing, rolling, roll forming, forging, extruding, pilgering, rocking, flow-turning, shear-spinning, hydro-forming, bulge forming, swaging, impact extruding, explosive forming, rubber forming, back extrusion, piercing, spinning, stretch forming, press bending, electromagnetic forming, heading, coining, and combinations of any thereof. In terms of the processes disclosed herein, these forming techniques impart cold work to an α+β titanium alloy when performed at temperatures no greater than 500° F. (260° C.).

In various embodiments, an α+β titanium alloy may be cold worked to a 20% to 60% reduction in area. For instance, an α+β titanium alloy workpiece, such as, for example, an ingot, a billet, a bar, a rod, a tube, a slab, or a plate, may be plastically deformed, for example, in a cold drawing, cold rolling, cold extrusion, or cold forging operation, so that a cross-sectional area of the workpiece is reduced by a percentage in the range of 20% to 60%. For cylindrical workpieces, such as, for example, round ingots, billets, bars, rods, and tubes, the reduction in area is measured for the circular or annular cross-section of the workpiece, which is generally perpendicular to the direction of movement of the workpiece through a drawing die, an extruding die, or the like. Likewise, the reduction in area of rolled workpieces is measured for the cross-section of the workpiece that is generally perpendicular to the direction of movement of the workpiece through the rolls of a rolling apparatus or the like.

In various embodiments, an α+β titanium alloy may be cold worked to a 20% to 60% reduction in area, or any sub-range therein, such as, for example, 30% to 60%, 40% to 60%, 50% to 60%, 20% to 50%, 20% to 40%, 20% to 30%, 30% to 50%, 30% to 40%, or 40% to 50%. An α+β titanium alloy may be cold worked to a 20% to 60% reduction in area with no observable edge cracking or other surface cracking. The cold working may be performed without any intermediate stress-relief annealing. In this manner, various embodiments of the processes disclosed herein can achieve reductions in area up to 60% without any intermediate stress-relief annealing between sequential cold working operations such as, for example, two or more passes through a cold drawing apparatus.

In various embodiments, a cold working operation may comprise at least two deformation cycles, wherein each deformation cycle comprises cold working an α+β titanium alloy to an at least 10% reduction in area. In various embodiments, a cold working operation may comprise at least two deformation cycles, wherein each deformation cycle comprises cold working an α+β titanium alloy to an at least 20% reduction in area. The at least two deformation cycles may achieve reductions in area up to 60% without any intermediate stress-relief annealing.

For example, in a cold drawing operation, a bar may be cold drawn in a first draw pass at ambient temperature to a greater than 20% reduction in area. The greater than 20% cold drawn bar may then be cold drawn in a second draw pass at ambient temperature to a second reduction in area of greater than 20%. The two cold draw passes may be performed without any intermediate stress-relief annealing between the two passes. In this manner, an α+β titanium alloy may be cold worked using at least two deformation cycles to achieve larger overall reductions in area. In a given implementation of a cold working operation, the forces required for cold deformation of an α+β titanium alloy will depend on parameters including, for example, the size and shape of the workpiece, the yield strength of the alloy material, the extent of deformation (e.g., reduction in area), and the particular cold working technique.

In various embodiments, after a cold working operation, a cold worked α+β titanium alloy may be aged at a temperature in the range of 700° F. to 1200° F. (371-649° C.), or any sub-range therein, such as, for example, 800° F. to 1150° F., 850° F. to 1150° F., 800° F. to 1100° F., or 850° F. to 1100° F. (i.e., 427-621° C., 454-621° C., 427-593° C., or 454-593° C.). The aging heat treatment may be performed for a temperature and for a time sufficient to provide a specified combination of mechanical properties, such as, for example, a specified ultimate tensile strength, a specified yield strength, and/or a specified elongation. In various embodiments, an aging heat treatment may be performed for up to 50 hours at temperature, for example. In various embodiments, an aging heat treatment may be performed for 0.5 to 10 hours at temperature, or any sub-range therein, such as, for example 1 to 8 hours at temperature. The aging heat treatment may be performed in a temperature-controlled furnace, such as, for example, an open-air gas furnace.

In various embodiments, the processes disclosed herein may further comprise a hot working operation performed before the cold working operation. A hot working operation may be performed in the α+β phase field. For example, a hot working operation may be performed at a temperature in the range of 300° F. to 25° F. (167-15° C.) below the β-transus temperature of the α+β titanium alloy. Generally, Kosaka alloys have a β-transus temperature of about 1765° F. to 1800° F. (963-982° C.). In various embodiments, an α+β titanium alloy may be hot worked at a temperature in the range of 1500° F. to 1775° F. (815-968° C.), or any sub-range therein, such as, for example, 1600° F. to 1775° F., 1600° F. to 1750° F., or 1600° F. to 1700° F. (i.e., 871-968° C., 871-954° C., or 871-927° C.).

In embodiments comprising a hot working operation before the cold working operation, the processes disclosed herein may further comprise an optional anneal or stress relief heat treatment between the hot working operation and the cold working operation. A hot worked α+β titanium alloy may be annealed at a temperature in the range of 1200° F. to 1500° F. (649-815° C.), or any sub-range therein, such as, for example, 1200° F. to 1400° F. or 1250° F. to 1300° F. (i.e., 649-760° C. or 677-704° C.).

In various embodiments, the processes disclosed herein may comprise an optional hot working operation performed in the β-phase field before a hot working operation performed in the α+β phase field. For example, a titanium alloy ingot may be hot worked in the β-phase field to form an intermediate article. The intermediate article may be hot worked in the α+β phase field to develop an α+β phase microstructure. After hot working, the intermediate article may be stress relief annealed and then cold worked at a temperature in the range of ambient temperature to 500° F. (260° C.). The cold worked article may be aged at a temperature in the range of 700° F. to 1200° F. (371-649° C.). Optional hot working in the β-phase field is performed at a temperature above the β-transus temperature of the alloy, for example, at a temperature in the range of 1800° F. to 2300° F. (982-1260° C.), or any sub-range therein, such as, for example, 1900° F. to 2300° F. or 1900° F. to 2100° F. (i.e., 1038-1260° C. or 1038-1149° C.).

In various embodiments, the processes disclosed herein may be characterized by the formation of an α+β titanium alloy article having an ultimate tensile strength in the range of 155 ksi to 200 ksi (1069-1379 MPa) and an elongation in the range of 8% to 20%, at ambient temperature. Also, in various embodiments, the processes disclosed herein may be characterized by the formation of an α+β titanium alloy article having an ultimate tensile strength in the range of 160 ksi to 180 ksi (1103-1241 MPa) and an elongation in the range of 8% to 20%, at ambient temperature. Further, in various embodiments, the processes disclosed herein may be characterized by the formation of an α+β titanium alloy article having an ultimate tensile strength in the range of 165 ksi to 180 ksi (1138-1241 MPa) and an elongation in the range of 8% to 17%, at ambient temperature.

In various embodiments, the processes disclosed herein may be characterized by the formation of an α+β titanium alloy article having a yield strength in the range of 140 ksi to 165 ksi (965-1138 MPa) and an elongation in the range of 8% to 20%, at ambient temperature. In addition, in various embodiments, the processes disclosed herein may be characterized by the formation of an α+β titanium alloy article having a yield strength in the range of 155 ksi to 165 ksi (1069-1138 MPa) and an elongation in the range of 8% to 15%, at ambient temperature.

In various embodiments, the processes disclosed herein may be characterized by the formation of an α+β titanium alloy article having an ultimate tensile strength in any sub-range subsumed within 155 ksi to 200 ksi (1069-1379 MPa), a yield strength in any sub-range subsumed within 140 ksi to 165 ksi (965-1138 MPa), and an elongation in any sub-range subsumed within 8% to 20%, at ambient temperature.

In various embodiments, the processes disclosed herein may be characterized by the formation of an α+β titanium alloy article having an ultimate tensile strength of greater than 155 ksi, a yield strength of greater than 140 ksi, and an elongation of greater than 8%, at ambient temperature. An α+β titanium alloy article forming according to various embodiments may have an ultimate tensile strength of greater than 166 ksi, greater than 175 ksi, greater than 185 ksi, or greater than 195 ksi, at ambient temperature. An α+β titanium alloy article forming according to various embodiments may have a yield strength of greater than 145 ksi, greater than 155 ksi, or greater than 160 ksi, at ambient temperature. An α+β titanium alloy article forming according to various embodiments may have an elongation of greater than 8%, greater than 10%, greater than 12%, greater than 14%, greater than 16%, or greater than 18%, at ambient temperature.

In various embodiments, the processes disclosed herein may be characterized by the formation of an α+β titanium alloy article having an ultimate tensile strength, a yield strength, and an elongation, at ambient temperature, that are at least as great as an ultimate tensile strength, a yield strength, and an elongation, at ambient temperature, of an otherwise identical article consisting of a Ti-6Al-4V alloy in a solution treated and aged (STA) condition.

In various embodiments, the processes disclosed herein may be used to thermomechanically process α+β titanium alloys comprising, consisting of, or consisting essentially of, in weight percentages, from 2.90% to 5.00% aluminum, from 2.00% to 3.00% vanadium, from 0.40% to 2.00% iron, from 0.10% to 0.30% oxygen, incidental elements, and titanium.

The aluminum concentration in the α+β titanium alloys thermomechanically processed according to the processes disclosed herein may range from 2.90 to 5.00 weight percent, or any sub-range therein, such as, for example, 3.00% to 5.00%, 3.50% to 4.50%, 3.70% to 4.30%, 3.75% to 4.25%, or 3.90% to 4.50%. The vanadium concentration in the α+β titanium alloys thermomechanically processed according to the processes disclosed herein may range from 2.00 to 3.00 weight percent, or any sub-range therein, such as, for example, 2.20% to 3.00%, 2.20% to 2.80%, or 2.30% to 2.70%. The iron concentration in the α+β titanium alloys thermomechanically processed according to the processes disclosed herein may range from 0.40 to 2.00 weight percent, or any sub-range therein, such as, for example, 0.50% to 2.00%, 1.00% to 2.00%, 1.20% to 1.80%, or 1.30% to 1.70%. The oxygen concentration in the α+β titanium alloys thermomechanically processed according to the processes disclosed herein may range from 0.10 to 0.30 weight percent, or any sub-range therein, such as, for example, 0.15% to 0.30%, 0.10% to 0.20%, 0.10% to 0.15%, 0.18% to 0.28%, 0.20% to 0.30%, 0.22% to 0.28%, 0.24% to 0.30%, or 0.23% to 0.27%.

In various embodiments, the processes disclosed herein may be used to thermomechanically process an α+β titanium alloy comprising, consisting of, or consisting essentially of the nominal composition of 4.00 weight percent aluminum, 2.50 weight percent vanadium, 1.50 weight percent iron, and 0.25 weight percent oxygen, titanium, and incidental impurities (Ti-4Al-2.5V-1.5Fe-0.250). An α+β titanium alloy having the nominal composition Ti-4Al-2.5V-1.5Fe-0.250 is commercially available as ATI 425® alloy from Allegheny Technologies Incorporated.

In various embodiments, the processes disclosed herein may be used to thermomechanically process α+β titanium alloys comprising, consisting of, or consisting essentially of, titanium, aluminum, vanadium, iron, oxygen, incidental impurities, and less than 0.50 weight percent of any other intentional alloying elements. In various embodiments, the processes disclosed herein may be used to thermomechanically process α+β titanium alloys comprising, consisting of, or consisting essentially of, titanium, aluminum, vanadium, iron, oxygen, and less than 0.50 weight percent of any other elements including intentional alloying elements and incidental impurities. In various embodiments, the maximum level of total elements (incidental impurities and/or intentional alloying additions) other than titanium, aluminum, vanadium, iron, and oxygen, may be 0.40 weight percent, 0.30 weight percent, 0.25 weight percent, 0.20 weight percent, or 0.10 weight percent.

In various embodiments, the α+β titanium alloys processed as described herein may comprise, consist essentially of, or consist of a composition according to AMS 6946A, section 3.1, which is incorporated by reference herein, and which specifies the composition provided in Table 1 (percentages by weight).

TABLE 1

| Element | Minimum | Maximum |
|---|---|---|
| Aluminum | 3.50 | 4.50 |
| Vanadium | 2.00 | 3.00 |
| Iron | 1.20 | 1.80 |
| Oxygen | 0.20 | 0.30 |
| Carbon | — | 0.08 |
| Nitrogen | — | 0.03 |
| Hydrogen | — | 0.015 |
| Other elements (each) | — | 0.10 |
| Other elements (total) | — | 0.30 |
| Titanium | remainder | |

In various embodiments, α+β titanium alloys processed as described herein may include various elements other than titanium, aluminum, vanadium, iron, and oxygen. For example, such other elements, and their percentages by weight, may include, but are not necessarily limited to, one or more of the following: (a) chromium, 0.10% maximum, generally from 0.0001% to 0.05%, or up to about 0.03%; (b) nickel, 0.10% maximum, generally from 0.001% to 0.05%, or up to about 0.02%; (c) molybdenum, 0.10% maximum; (d) zirconium, 0.10% maximum; (e) tin, 0.10% maximum; (f) carbon, 0.10% maximum, generally from 0.005% to 0.03%, or up to about 0.01%; and/or (g) nitrogen, 0.10% maximum, generally from 0.001% to 0.02%, or up to about 0.01%.

The processes disclosed herein may be used to form articles such as, for example, billets, bars, rods, wires, tubes, pipes, slabs, plates, structural members, fasteners, rivets, and the like. In various embodiments, the processes disclosed herein produce articles having an ultimate tensile strength in the range of 155 ksi to 200 ksi (1069-1379 MPa), a yield strength in the range of 140 ksi to 165 ksi (965-1138 MPa), and an elongation in the range of 8% to 20%, at ambient temperature, and having a minimum dimension (e.g., diameter or thickness) of greater than 0.5 inch, greater than 1.0 inch, greater than 2.0 inches, greater than 3.0 inches, greater than 4.0 inches, greater than 5.0 inches, or greater than 10.0 inches (i.e., greater than 1.27 cm, 2.54 cm, 5.08 cm, 7.62 cm, 10.16 cm, 12.70 cm, or 24.50 cm).

Further, one of the various advantages of embodiments of the processes disclosed herein is that high strength α+β titanium alloy articles can be formed without a size limitation, which is an inherent limitation of STA processing. As a result, the processes disclosed herein can produce articles having an ultimate tensile strength of greater than 165 ksi (1138 MPa), a yield strength of greater than 155 ksi (1069 MPa), and an elongation of greater than 8%, at ambient temperature, with no inherent limitation on the maximum value of the small dimension (e.g., diameter or thickness) of the article. Therefore, the maximum size limitation is only driven by the size limitations of the cold working equipment used to perform cold working in accordance with the embodiments disclosed herein. In contrast, STA processing places an inherent limit on the maximum value of the small dimension of an article that can achieve high strength, e.g., a 0.5 inch (1.27 cm) maximum for Ti-6Al-4V articles exhibiting an at least 165 ksi (1138 MPa) ultimate tensile strength and an at least 155 ksi (1069 MPa) yield strength, at room temperature. See AMS 6930A.

In addition, the processes disclosed herein can produce α+β titanium alloy articles having high strength with low or zero thermal stresses and better dimensional tolerances than high strength articles produced using STA processing. Cold drawing and direct aging according to the processes disclosed herein do not impart problematic internal thermal stresses, do not cause warping of articles, and do not cause dimensional distortion of articles, which is known to occur with STA processing of α+β titanium alloy articles.

The process disclosed herein may also be used to form α+β titanium alloy articles having mechanical properties falling within a broad range depending on the level of cold work and the time/temperature of the aging treatment. In various embodiments, ultimate tensile strength may range from about 155 ksi to over 180 ksi (about 1069 MPa to over 1241 MPa), yield strength may range from about 140 ksi to about 163 ksi (965-1124 MPa), and elongation may range from about 8% to over 19%. Different mechanical properties can be achieved through different combinations of cold working and aging treatment. In various embodiments, higher levels of cold work (e.g., reductions) may correlate with higher strength and lower ductility, while higher aging temperatures may correlate with lower strength and higher ductility. In this manner, cold working and aging cycles may be specified in accordance with the embodiments disclosed herein to achieve controlled and reproducible levels of strength and ductility in α+β titanium alloy articles. This allows for the production of α+β titanium alloy articles having tailorable mechanical properties.

The illustrative and non-limiting examples that follow are intended to further describe various non-limiting embodiments without restricting the scope of the embodiments. Persons having ordinary skill in the art will appreciate that variations of the Examples are possible within the scope of the invention as defined by the claims.

EXAMPLES

Example 1

5.0 inch diameter cylindrical billets of alloy from two different heats having an average chemical composition presented in Table 2 (exclusive of incidental impurities) were hot rolled in the α+β phase field at a temperature of 1600° F. (871° C.) to form 1.0 inch diameter round bars.

TABLE 2

| Heat | Al | V | Fe | O | N | C | Ti |
|---|---|---|---|---|---|---|---|
| X | 4.36 | 2.48 | 1.28 | 0.272 | 0.005 | 0.010 | Balance |
| Y | 4.10 | 2.31 | 1.62 | 0.187 | 0.004 | 0.007 | Balance |

The 1.0 inch round bars were annealed at a temperature of 1275° F. for one hour and air cooled to ambient temperature. The annealed bars were cold worked at ambient temperature using drawing operations to reduce the diameters of the bars. The amount of cold work performed on the bars during the cold draw operations was quantified as the percentage reductions in the circular cross-sectional area for the round bars during cold drawing. The cold work percentages achieved were 20%, 30%, or 40% reductions in area (RA). The drawing operations were performed using a single draw pass for 20% reductions in area and two draw passes for 30% and 40% reductions in area, with no intermediate annealing.

Figure 2:
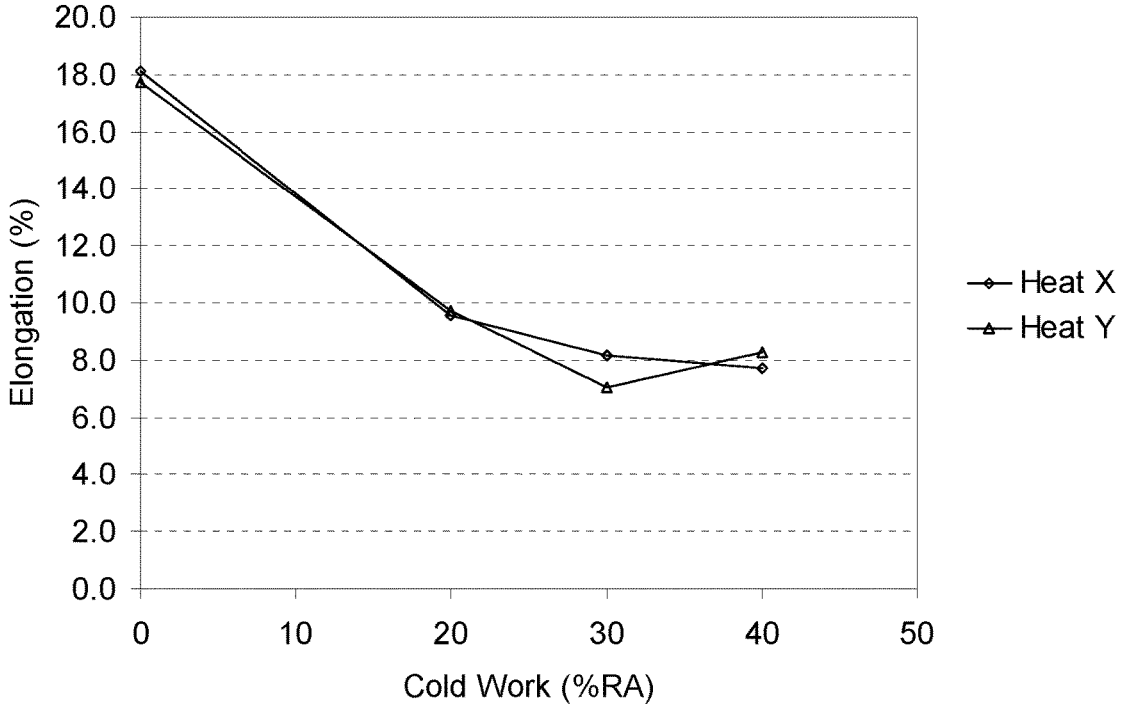
FIG. 2 is a graph of average ductility quantified as tensile elongation percentage for cold drawn α+β titanium alloy bars in an as-drawn condition.

The ultimate tensile strength (UTS), yield strength (YS), and elongation (%) were measured at ambient temperature for each cold drawn bar (20%, 30%, and 40% RA) and for 1-inch diameter bars that were not cold drawn (0% RA). The averaged results are presented in Table 3 and FIGS. 1 and 2.

TABLE 3

| Heat | Cold Draw (% RA) | UTS (ksi) | YS (ksi) | Elongation (%) |
|---|---|---|---|---|
| X | 0 | 144.7 | 132.1 | 18.1 |
| | 20 | 176.3 | 156.0 | 9.5 |
| | 30 | 183.5 | 168.4 | 8.2 |
| | 40 | 188.2 | 166.2 | 7.7 |
| Y | 0 | 145.5 | 130.9 | 17.7 |
| | 20 | 173.0 | 156.3 | 9.7 |
| | 30 | 181.0 | 163.9 | 7.0 |
| | 40 | 182.8 | 151.0 | 8.3 |

The ultimate tensile strength generally increased with increasing levels of cold work, while elongation generally decreased with increasing levels of cold work up to about 20-30% cold work. Alloys cold worked to 30% and 40% retained about 8% elongation with ultimate tensile strengths greater than 180 ksi and approaching 190 ksi. Alloys cold worked to 30% and 40% also exhibited yield strengths in the range of 150 ksi to 170 ksi.

Example 2

5-inch diameter cylindrical billets having the average chemical composition of Heat X presented in Table 1 (β-transus temperature of 1790° F.) were thermomechanically processed as described in Example 1 to form round bars having cold work percentages of 20%, 30%, or 40% reductions in area. After cold drawing, the bars were directly aged using one of the aging cycles presented in Table 4, followed by an air cool to ambient temperature.

TABLE 4

| Aging Temperature (° F.) | Aging Time (hour) |
|---|---|
| 850 | 1.00 |
| 850 | 8.00 |
| 925 | 4.50 |
| 975 | 2.75 |
| 975 | 4.50 |
| 975 | 6.25 |
| 1100 | 1.00 |
| 1100 | 8.00 |

Figure 3:
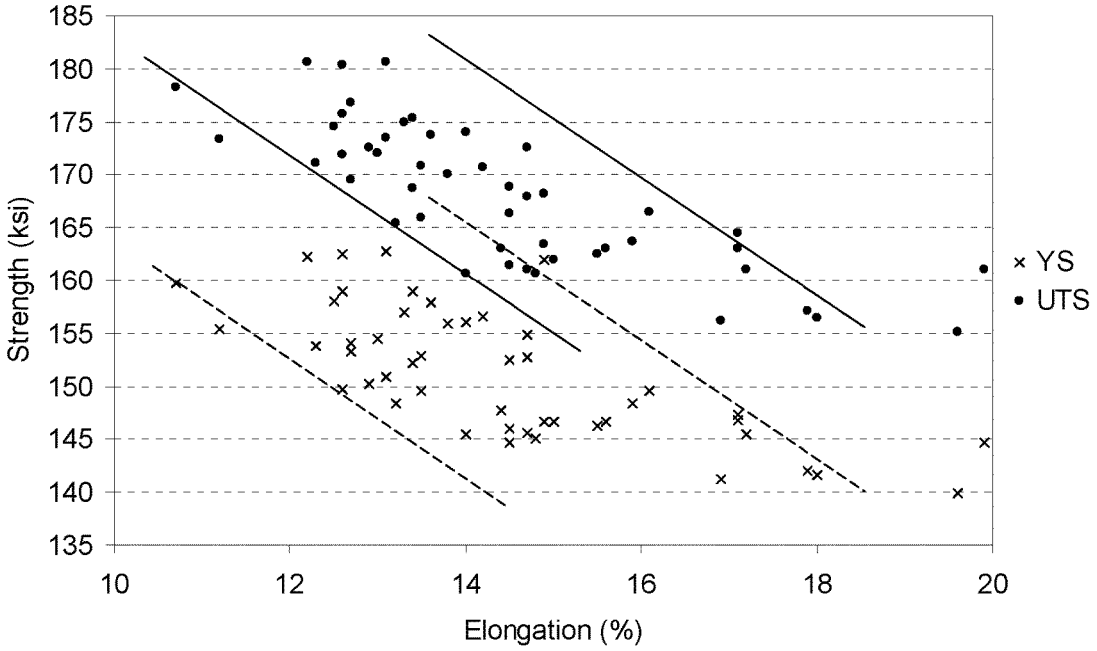
FIG. 3 is a graph of ultimate tensile strength and yield strength versus elongation percentage for α+β titanium alloy bars after being cold worked and directly aged according to embodiments of the processes disclosed herein.
Figure 4:
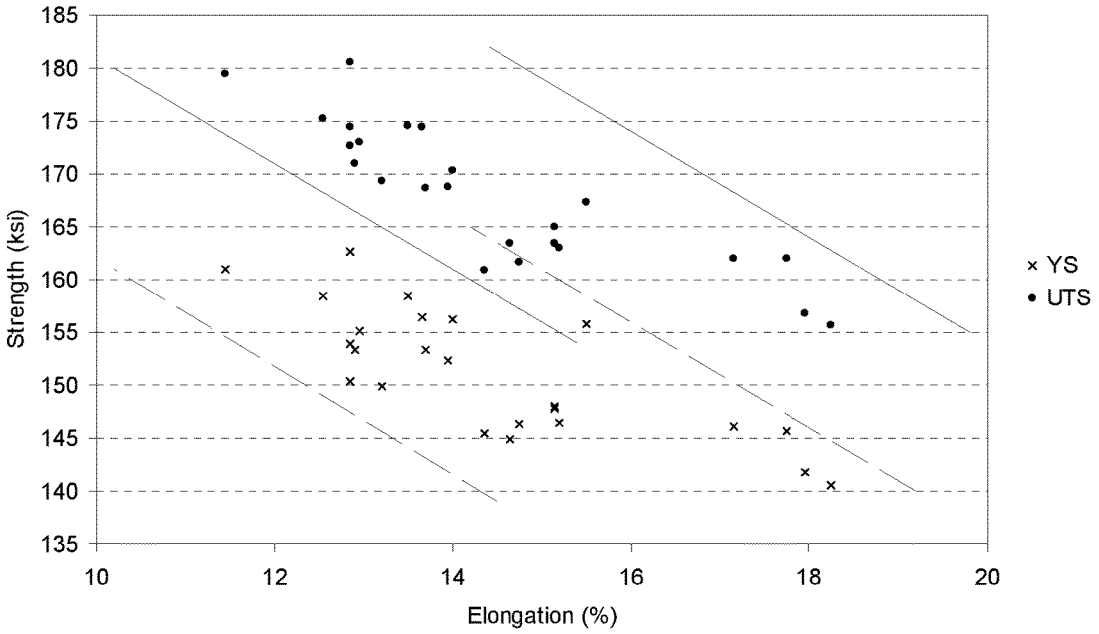
FIG. 4 is a graph of average ultimate tensile strength and average yield strength versus average elongation for α+β titanium alloy bars after being cold worked and directly aged according to embodiments of the processes disclosed herein.

The ultimate tensile strength, yield strength, and elongation were measured at ambient temperature for each cold drawn and aged bar. The raw data are presented in FIG. 3 and the averaged data are presented in FIG. 4 and Table 5.

TABLE 5

| Cold Draw (% RA) | Aging Temperature (° F.) | Aging Time (hour) | UTS (ksi) | YS (ksi) | Elongation (%) |
|---|---|---|---|---|---|
| 20 | 850 | 1.00 | 170.4 | 156.2 | 14.0 |
| 30 | 850 | 1.00 | 174.6 | 158.5 | 13.5 |
| 40 | 850 | 1.00 | 180.6 | 162.7 | 12.9 |
| 20 | 850 | 8.00 | 168.7 | 153.4 | 13.7 |
| 30 | 850 | 8.00 | 175.2 | 158.5 | 12.6 |
| 40 | 850 | 8.00 | 179.5 | 161.0 | 11.5 |
| 20 | 925 | 4.50 | 163.4 | 148.0 | 15.2 |
| 30 | 925 | 4.50 | 168.8 | 152.3 | 14.0 |
| 40 | 925 | 4.50 | 174.5 | 156.5 | 13.7 |
| 20 | 975 | 2.75 | 161.7 | 146.4 | 14.8 |
| 30 | 975 | 2.75 | 167.4 | 155.8 | 15.5 |
| 40 | 975 | 2.75 | 173.0 | 155.1 | 13.0 |
| 20 | 975 | 4.50 | 160.9 | 145.5 | 14.4 |
| 30 | 975 | 4.50 | 169.3 | 149.9 | 13.2 |
| 40 | 975 | 4.50 | 174.4 | 153.9 | 12.9 |
| 20 | 975 | 6.25 | 163.5 | 144.9 | 14.7 |
| 30 | 975 | 6.25 | 172.7 | 150.3 | 12.9 |
| 40 | 975 | 6.25 | 171.0 | 153.4 | 12.9 |

TABLE 5-continued

| Cold Draw (% RA) | Aging Temperature (° F.) | Aging Time (hour) | UTS (ksi) | YS (ksi) | Elongation (%) |
|---|---|---|---|---|---|
| 20 | 1100 | 1.00 | 155.7 | 140.6 | 18.3 |
| 30 | 1100 | 1.00 | 163.0 | 146.5 | 15.2 |
| 40 | 1100 | 1.00 | 165.0 | 147.8 | 15.2 |
| 20 | 1100 | 8.00 | 156.8 | 141.8 | 18.0 |
| 30 | 1100 | 8.00 | 162.1 | 146.1 | 17.2 |
| 40 | 1100 | 8.00 | 162.1 | 145.7 | 17.8 |

The cold drawn and aged alloys exhibited a range of mechanical properties depending on the level of cold work and the time/temperature cycle of the aging treatment. Ultimate tensile strength ranged from about 155 ksi to over 180 ksi. Yield strength ranged from about 140 ksi to about 163 ksi. Elongation ranged from about 11% to over 19%. Accordingly, different mechanical properties can be achieved through different combinations of cold work level and aging treatment.

Figure 5:
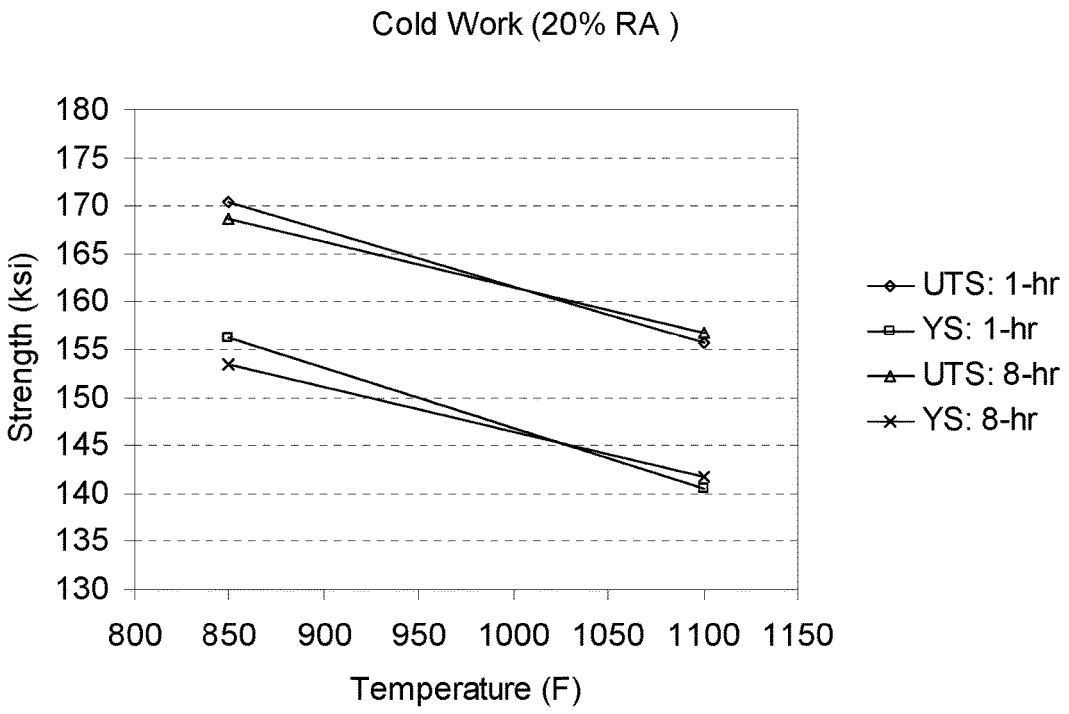
FIG. 5 is a graph of average ultimate tensile strength and average yield strength versus aging temperature for α+β titanium alloy bars cold worked to 20% reductions in area and aged for 1 hour or 8 hours at temperature.
Figure 6:
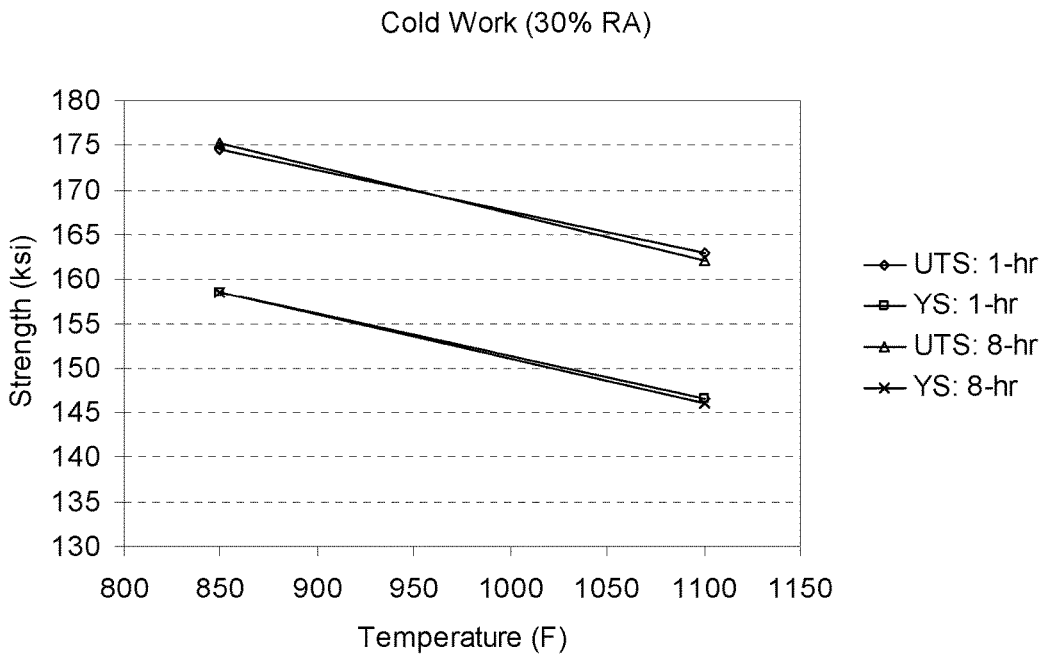
FIG. 6 is a graph of average ultimate tensile strength and average yield strength versus aging temperature for α+β titanium alloy bars cold worked to 30% reductions in area and aged for 1 hour or 8 hours at temperature.
Figure 7:
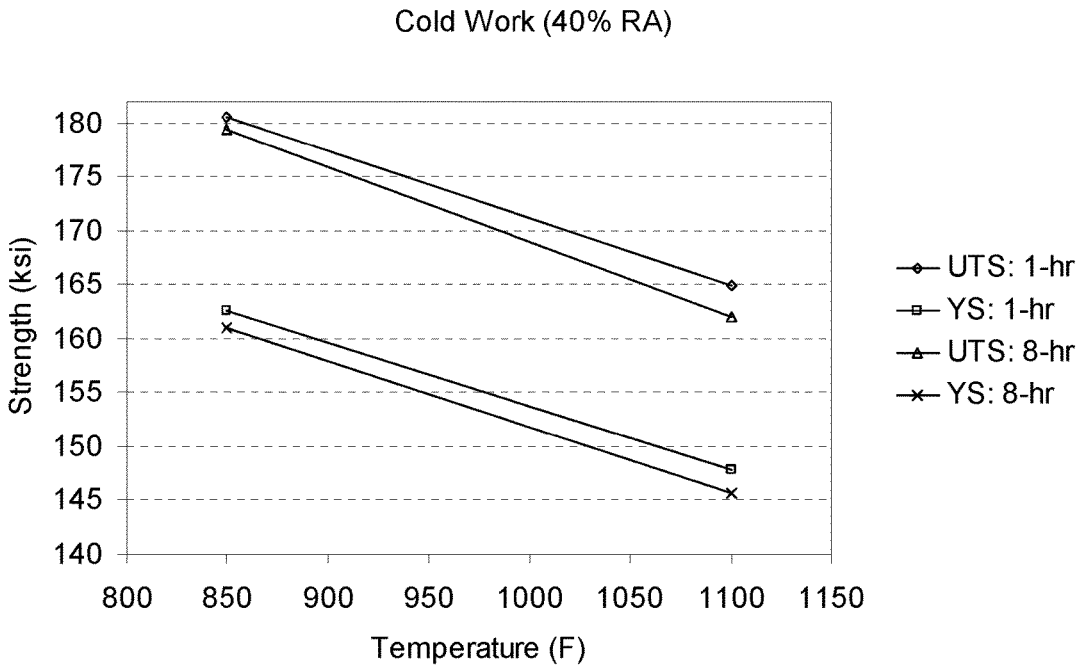
FIG. 7 is a graph of average ultimate tensile strength and average yield strength versus aging temperature for α+β titanium alloy bars cold worked to 40% reductions in area and aged for 1 hour or 8 hours at temperature.
Figure 8:
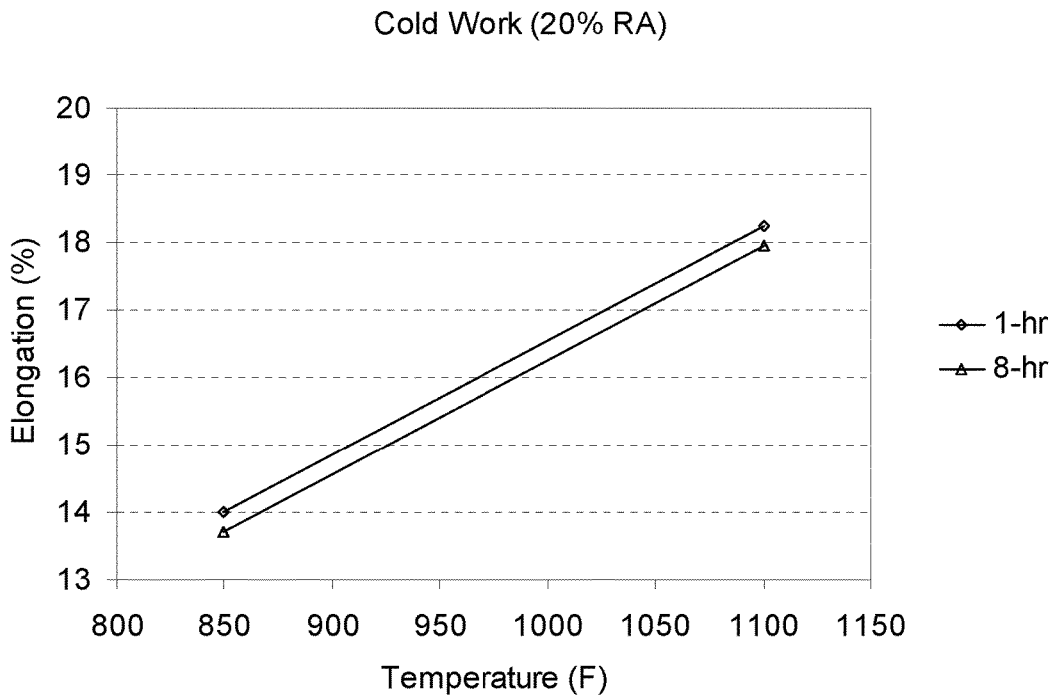
FIG. 8 is a graph of average elongation versus aging temperature for α+β titanium alloy bars cold worked to 20% reductions in area and aged for 1 hour or 8 hours at temperature.
Figure 9:
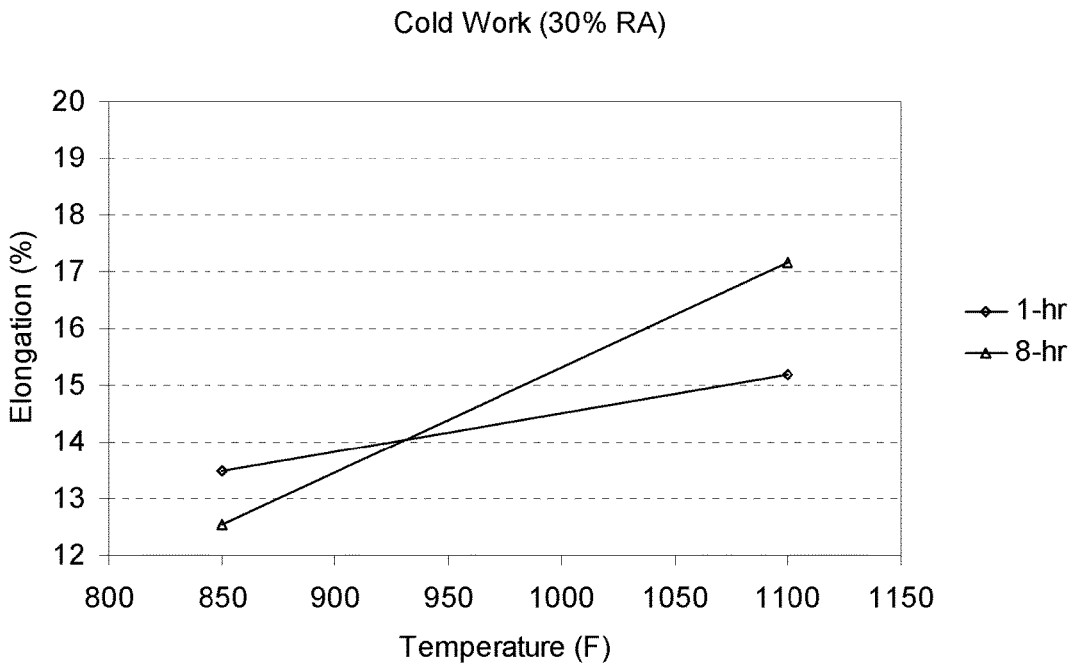
FIG. 9 is a graph of average elongation versus aging temperature for α+β titanium alloy bars cold worked to 30% reductions in area and aged for 1 hour or 8 hours at temperature.
Figure 10:
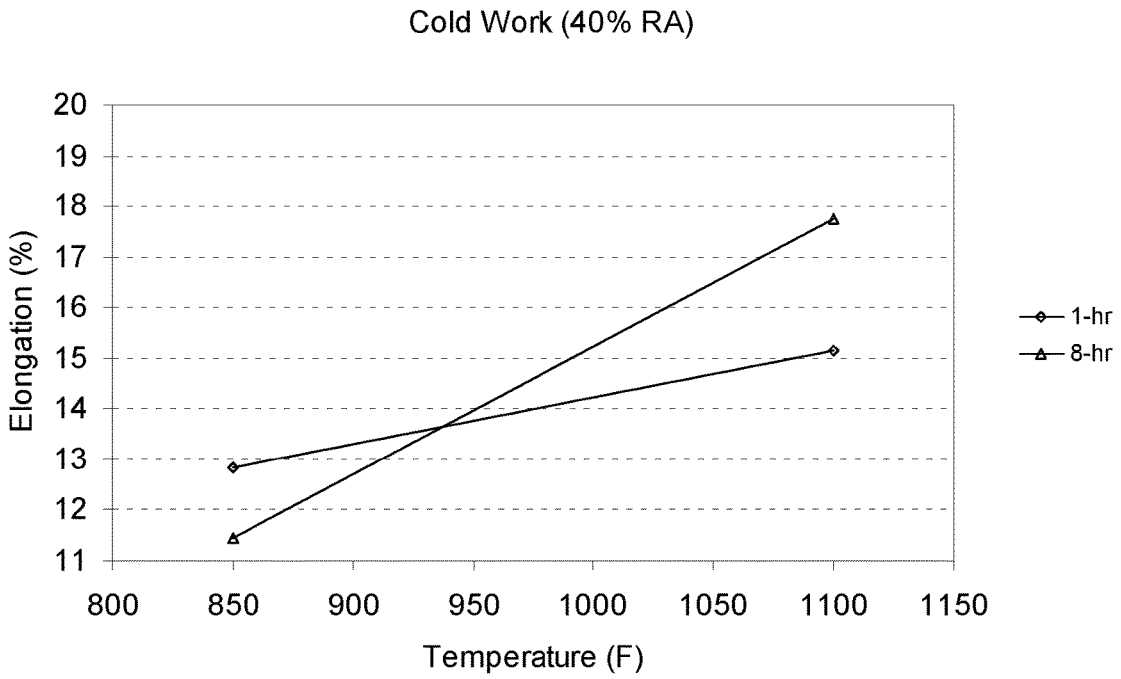
FIG. 10 is a graph of average elongation versus aging temperature for α+β titanium alloy bars cold worked to 40% reductions in area and aged for 1 hour or 8 hours at temperature.
Figure 11:
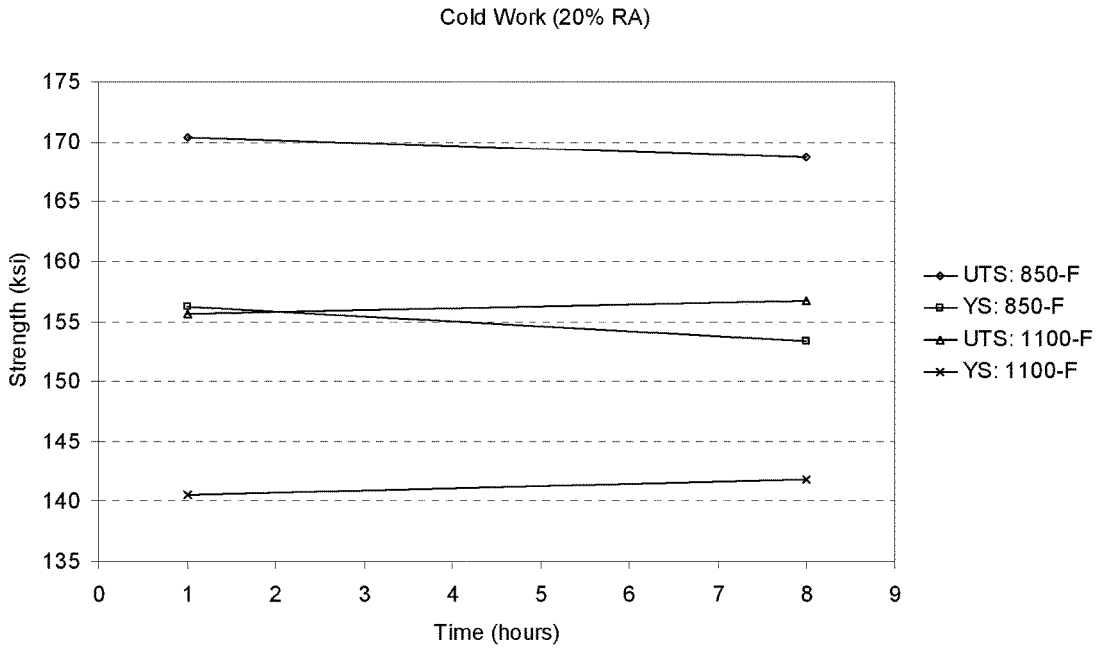
FIG. 11 is a graph of average ultimate tensile strength and average yield strength versus aging time for α+β titanium alloy bars cold worked to 20% reductions in area and aged at 850° F. (454° C.) or 1100° F. (593° C.)
Figure 12:
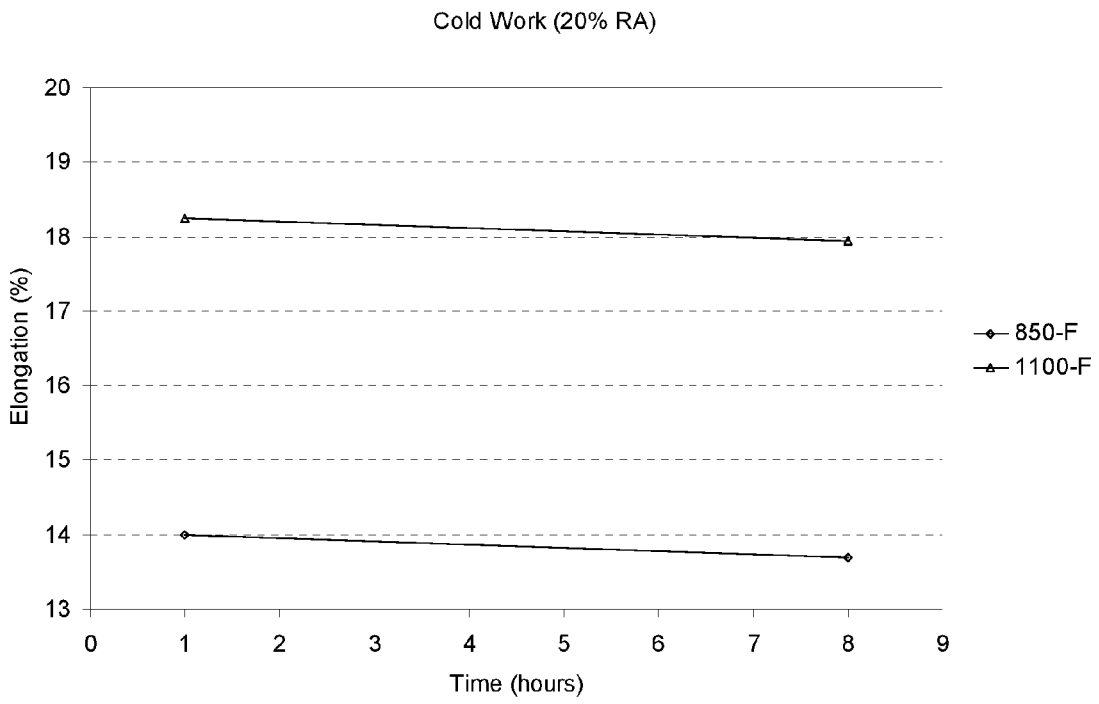
FIG. 12 is a graph of average elongation versus aging time for α+β titanium alloy bars cold worked to 20% reductions in area and aged at 850° F. (454° C.) or 1100° F. (593° C.).

Higher levels of cold work generally correlated with higher strength and lower ductility. Higher aging temperatures generally correlated with lower strength. This is shown in FIGS. 5, 6, and 7, which are graphs of strength (average UTS and average YS) versus temperature for cold work percentages of 20%, 30%, and 40% reductions in area, respectively. Higher aging temperatures generally correlated with higher ductility. This is shown in FIGS. 8, 9, and 10, which are graphs of average elongation versus temperature for cold work percentages of 20%, 30%, and 40% reductions in area, respectively. The duration of the aging treatment does not appear to have a significant effect on mechanical properties as illustrated in FIGS. 11 and 12, which are graphs of strength and elongation, respectively, versus time for cold work percentage of 20% reduction in area.

Example 3

Cold drawn round bars having the chemical composition of Heat X presented in Table 1, diameters of 0.75 inches, and processed as described in Examples 1 and 2 to 40% reductions in area during a drawing operation were double shear tested according to NASM 1312-13 (Aerospace Industries Association, Feb. 1, 2003, incorporated by reference herein). Double shear testing provides an evaluation of the applicability of this combination of alloy chemistry and thermo-mechanical processing for the production of high strength fastener stock. A first set of round bars was tested in the as-drawn condition and a second set of round bars was tested after being aged at 850° F. for 1 hour and air cooled to ambient temperature (850/1/AC). The double shear strength results are presented in Table 6 along with average values for ultimate tensile strength, yield strength, and elongation. For comparative purposes, the minimum specified values for these mechanical properties for Ti-6Al-4V fastener stock are also presented in Table 6.

TABLE 6

| Condition | Size | Cold Draw (% RA) | UTS (ksi) | YS (ksi) | Elongation (%) | Double Shear Strength (ksi) |
|---|---|---|---|---|---|---|
| as-drawn | 0.75 | 40 | 188.2 | 166.2 | 7.7 | 100.6<br>102 |

TABLE 6-continued

| Condition | Size | Cold Draw (% RA) | UTS (ksi) | YS (ksi) | Elongation (%) | Double Shear Strength (ksi) |
|---|---|---|---|---|---|---|
| 850/1/AC | 0.75 | 40 | 180.6 | 162.7 | 12.9 | 103.2<br>102.4 |
| Ti-6-4 Target | 0.75 | N/A | 165 | 155 | 10 | 102 |

The cold drawn and aged alloys exhibited mechanical properties superior to the minimum specified values for Ti-6Al-4V fastener stock applications. As such, the processes disclosed herein may offer a more efficient alternative to the production of Ti-6Al-4V articles using STA processing.

Cold working and aging α+β titanium alloys comprising, in weight percentages, from 2.90 to 5.00 aluminum, from 2.00 to 3.00 vanadium, from 0.40 to 2.00 iron, from 0.10 to 0.30 oxygen, and titanium, according to the various embodiments disclosed herein, produces alloy articles having mechanical properties that exceed the minimum specified mechanical properties of Ti-6Al-4V alloys for various applications, including, for example, general aerospace applications and fastener applications. As noted above, Ti-6Al-4V alloys require STA processing to achieve the necessary strength required for critical applications, such as, for example, aerospace applications. As such, high strength Ti-6Al-4V alloys are limited by the size of the articles due to the inherent physical properties of the material and the requirement for rapid quenching during STA processing. In contrast, high strength cold worked and aged α+β titanium alloys, as described herein, are not limited in terms of article size and dimensions. Further, high strength cold worked and aged α+β titanium alloys, as described herein, do not experience large thermal and internal stresses or warping, which may be characteristic of thicker section Ti-6Al-4V alloy articles during STA processing.

This disclosure has been written with reference to various exemplary, illustrative, and non-limiting embodiments. However, it will be recognized by persons having ordinary skill in the art that various substitutions, modifications, or combinations of any of the disclosed embodiments (or portions thereof) may be made without departing from the scope of the invention. Thus, it is contemplated and understood that the present disclosure embraces additional embodiments not expressly set forth herein. Such embodiments may be obtained, for example, by combining, modifying, or reorganizing any of the disclosed steps, components, elements, features, aspects, characteristics, limitations, and the like, of the embodiments described herein. In this regard, Applicant reserves the right to amend the claims during prosecution to add features as variously described herein.

What is claimed is:

1. A process comprising:

cold working an α+β titanium alloy workpiece at a temperature in the range of ambient temperature to 500° F.; and direct aging the cold-worked α+β titanium alloy workpiece at a temperature in the range of 700° F. to 1200° F. without any quenching intermediate cold working the α+β titanium alloy workpiece and direct aging the cold-worked α+β titanium alloy workpiece;

the α+β titanium alloy comprising, in weight percentages, from 2.90 to 5.00 aluminum, from 2.00 to 3.00 vanadium, from 0.40 to 2.00 iron, from 0.10 to 0.30 oxygen, titanium, and incidental impurities, wherein the cold working and direct aging forms an α+β titanium alloy article having an ultimate tensile strength (UTS) and an elongation that satisfy the equation:

$$5\times(\text{Elongation in }\%)+(\text{UTS in ksi})\geq 230.$$

2. The process of claim 1 comprising cold working the α+β titanium alloy workpiece to a 20% to 60% reduction in area.

3. The process of claim 1, wherein the cold working of the α+β titanium alloy comprises at least two deformation cycles, wherein each deformation cycle comprises cold working the α+β titanium alloy workpiece to an at least 10% reduction in area.

4. The process of claim 1 comprising cold working the α+β titanium alloy workpiece at ambient temperature.

5. The process of claim 1 comprising direct aging the α+β titanium alloy workpiece at a temperature in the range of 800° F. to 1100° F.

6. The process of claim 1 comprising direct aging the α+β titanium alloy workpiece for 0.5 to 10 hours at temperature.

7. The process of claim 1 comprising hot working the α+β titanium alloy workpiece at a temperature in the range of 300° F. to 25° F. below the β-transus temperature of the α+β titanium alloy, wherein the hot working is performed before the cold working.

8. The process of claim 1 comprising hot working the α+β titanium alloy workpiece at a temperature in the range of 1500° F. to 1775° F., wherein the hot working is performed before the cold working.

9. The process of claim 7 comprising annealing the α+β titanium alloy at a temperature in the range of 1200° F. to 1500° F., wherein the annealing is performed between the hot working and the cold working.

10. The process of claim 1, wherein the cold working and direct aging forms an α+β titanium alloy article having an ultimate tensile strength in the range of 155 ksi to 200 ksi and an elongation in the range of 8% to 20%, at ambient temperature.

11. The process of claim 10, wherein the α+β titanium alloy article is selected from the group consisting of a billet, a bar, a rod, a tube, a slab, a plate, and a fastener.

12. The process of claim 10, wherein the α+β titanium alloy article has a diameter or thickness greater than 0.5 inches, an ultimate tensile strength greater than 165 ksi, a yield strength greater than 155 ksi, and an elongation greater than 12%.

13. The process of claim 1, wherein cold working the α+β titanium alloy workpiece comprises cold working by at least one operation selected from the group consisting of rolling, forging, extruding, pilgering, and drawing.

14. A process comprising:

hot working an α+β titanium alloy workpiece at a temperature in the range of 1500° F. to 1775° F.;

annealing the α+β titanium alloy at a temperature in the range of 1200° F. to 1500° F.;

cold working the α+β titanium alloy workpiece at ambient temperature to a 20% to 60% reduction in area; and direct aging the cold worked α+β titanium alloy workpiece at a temperature in the range of 800° F. to 1100° F. without any quenching intermediate cold working the α+β titanium alloy workpiece and direct aging the cold worked α+β titanium alloy workpiece;

the α+β titanium alloy comprising, in weight percentages, from 2.90 to 5.00 aluminum, from 2.00 to 3.00 vanadium, from 0.40 to 2.00 iron, from 0.10 to 0.30 oxygen, titanium, and incidental impurities, wherein the cold working and direct aging forms an α+β titanium alloy article having an ultimate tensile strength (UTS) and an elongation that satisfy the equation:

$$5\times(\text{Elongation in }\%)+(\text{UTS in ksi})\geq 230.$$

15. The process of claim 14, wherein the cold working of the α+β titanium alloy comprises at least two deformation cycles, wherein each deformation cycle comprises cold working the α+β titanium alloy workpiece to an at least 10% reduction in area.

16. The process of claim 14 comprising direct aging the α+β titanium alloy workpiece for 0.5 to 10 hours at temperature.

17. The process of claim 14 hot working the α+β titanium alloy workpiece at a temperature in the range of 300° F. to 25° F. below the β-transus temperature of the α+β titanium alloy, wherein the hot working is performed before the cold working.

18. The process of claim 14, wherein the cold working and direct aging forms an α+β titanium alloy article having an ultimate tensile strength in the range of 155 ksi to 200 ksi and an elongation in the range of 8% to 20%, at ambient temperature.

19. The process of claim 18, wherein the α+β titanium alloy article is selected from the group consisting of a billet, a bar, a rod, a tube, a slab, a plate, and a fastener.

20. The process of claim 18, wherein the α+β titanium alloy article has a diameter or thickness greater than 0.5 inches, an ultimate tensile strength greater than 165 ksi, a yield strength greater than 155 ksi, and an elongation greater than 12%.

21. The process of claim 14, wherein cold working the α+β titanium alloy workpiece comprises cold working by at least one operation selected from the group consisting of rolling, forging, extruding, pilgering, and drawing.

* * * * *